US008234892B2

(12) United States Patent
Laverty et al.

(10) Patent No.: US 8,234,892 B2
(45) Date of Patent: Aug. 7, 2012

(54) MORTISE LOCK

(75) Inventors: Edward T. Laverty, Brisbane (AU); Michael David Swales, Riverview (AU); Morrison John Just, Corinda (AU); Dana Shari Voysey, Auckland (NZ)

(73) Assignee: Assa Abloy Australia Pty. Limited, Oakleigh VIC (AU)

( * ) Notice: Subject to any disclaimer, the term of this patent is extended or adjusted under 35 U.S.C. 154(b) by 465 days.

(21) Appl. No.: 12/464,934

(22) Filed: May 13, 2009

(65) Prior Publication Data

US 2009/0282877 A1 Nov. 19, 2009

(30) Foreign Application Priority Data

May 13, 2008 (AU) ..... 2008902348
May 27, 2008 (AU) ..... 2008902648

(51) Int. Cl.
*E05B 59/00* (2006.01)

(52) U.S. Cl. ..... 70/107; 70/134; 292/34; 292/165

(58) Field of Classification Search ..... 70/107, 70/108, 110, 129, 134, 478, 486, 157; 292/32, 292/34, 36, 165, 169.14, 169.16
See application file for complete search history.

(56) References Cited

U.S. PATENT DOCUMENTS 3,672,714 A * 6/1972 Schultz ..... 292/34
3,808,849 A * 5/1974 Alexander ..... 70/149
5,765,410 A * 6/1998 Kwan et al. ..... 70/107
5,813,255 A * 9/1998 Tell et al. ..... 70/107
6,393,878 B1 * 5/2002 Fayngersh et al. ..... 70/107
7,497,486 B1 * 3/2009 Davis et al. ..... 292/32
2004/0017087 A1 * 1/2004 Ayres et al. ..... 292/165
2009/0078011 A1 * 3/2009 Avni ..... 70/486
2010/0263418 A1 * 10/2010 Moon ..... 70/107

FOREIGN PATENT DOCUMENTS

AU 2004229071 6/2005

* cited by examiner

*Primary Examiner* — Suzanne Barrett
(74) *Attorney, Agent, or Firm* — DeLio & Peterson, LLC; Thomas E. Ciesco

(57) ABSTRACT

A mortice lock is disclosed which has a lock casing which provides a first point of entrapment and a second point of entrapment, a latch bolt which can move between a latching position and an unlatching position, a handle for moving the latch bolt between the latching position and the un-latching position, a key cylinder, an operating assembly and a locking member. The operating assembly can move between a first position in which a deflectable portion of the operating assembly engages with the first point of entrapment and a second position in which the deflectable portion engages with the second point of entrapment. Only the key cylinder can move the operating assembly between the first position and the second position. The locking member (which is not a shoot bolt or part thereof) can move between a locking position in which a portion of the locking member engages with the latch bolt to prevent the latch bolt from moving into the un-latching position, and an unlocking position in which the latch bolt can move into the un-latching position. The locking member is operatively associated with the operating assembly such that moving the operating assembly into the first position moves the locking member into the unlocking position and moving the operating assembly into the second position moves the locking member into the locking position.

15 Claims, 18 Drawing Sheets

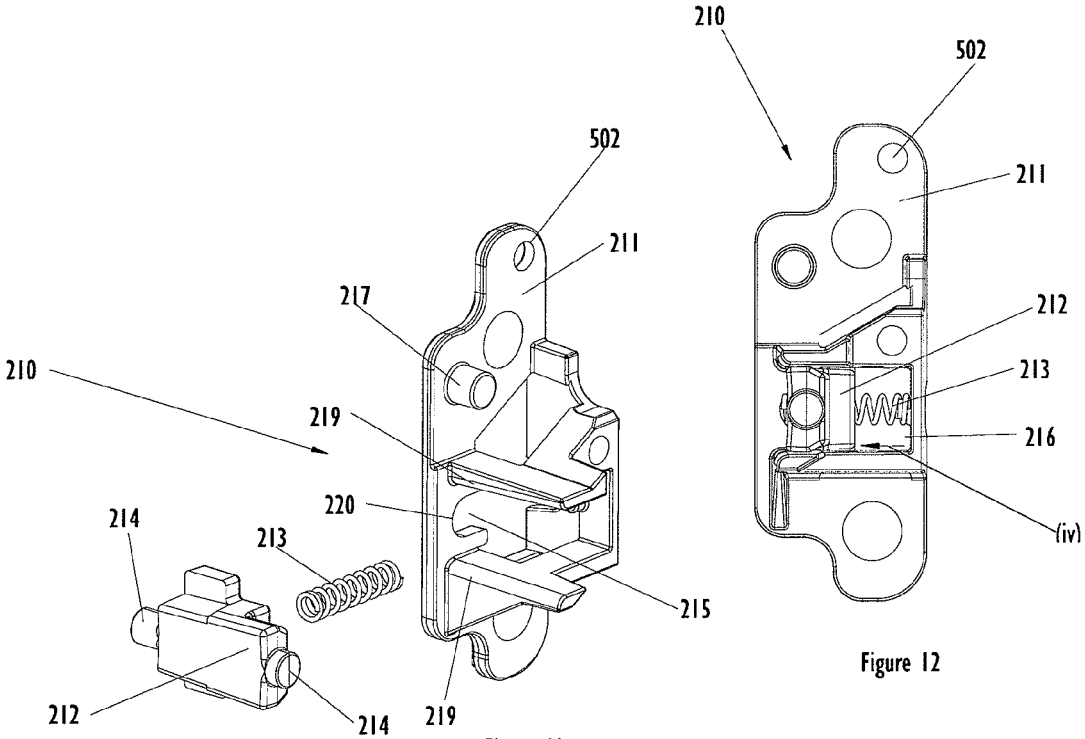
Figure 12
Figure 11
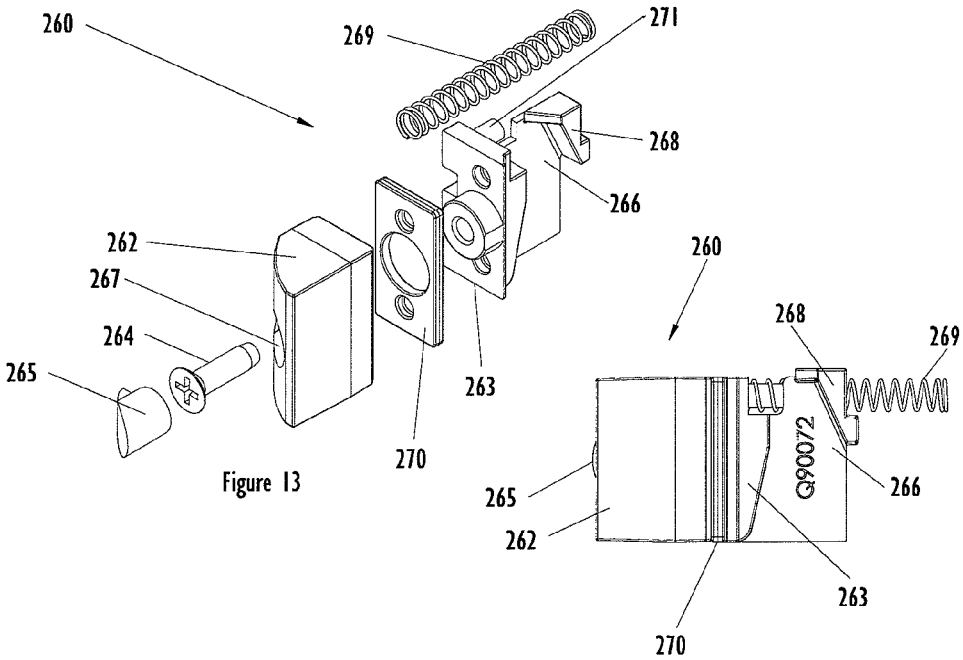
Figure 13
Figure 14

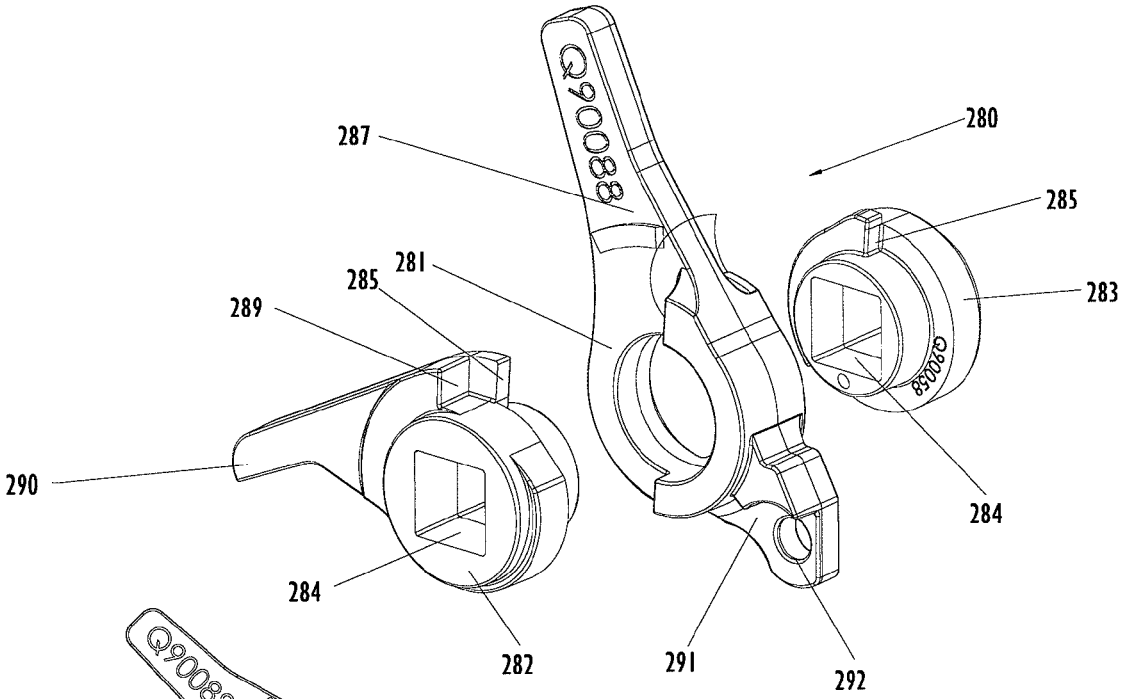
Figure 20
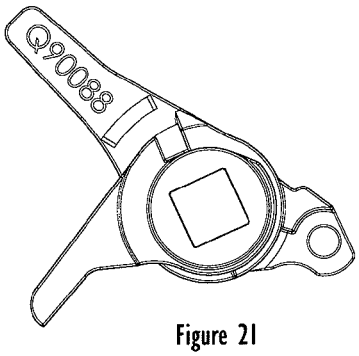
Figure 21
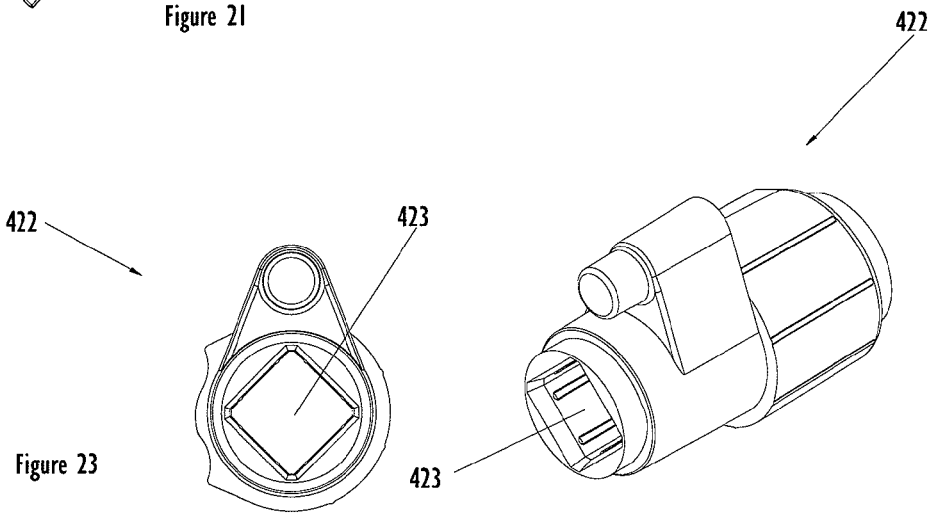
Figure 23
Figure 22

MORTISE LOCK

FIELD OF THE INVENTION

The present invention relates to mortice locks. The invention will be described primarily with reference to mortice locks for hinged doors. However it will be clearly appreciated that the invention may also be applicable to or usable on other types of wings such as hinged windows, sliding doors, bi-fold doors etc.

BACKGROUND

The term "mortice lock" generally refers to a lock which is designed to be inserted into the edge of a door (i.e. inserted into a space or "mortice" in the door's side edge) rather than being mounted on the inside or outside surface of the door. Mortice locks typically have one or more latches or bolts which can project from the lock, through the side edge of the door, to engage with a strike or some other part of the doorframe when the door is closed. The latches/bolts therefore retain the door closed and must be retracted back into the lock to allow the door to be opened.

A wide range of mortice lock designs have been proposed and used in the marketplace. They range from relatively simple locks which provide a basic level of security to higher end locks which provide a greater level of security. It should be appreciated that just because the "simple" locks provide a lower level of security, this does not mean they are inferior to the higher end locks. Indeed, different applications call for locks with differing levels of security, and in some situations a simple lock which provides a lower level of security would be preferable or more suitable. Of course, there are also situations in which a higher level of security is preferable or required.

Because different locks providing differing levels of security are often required in different situations, it is generally necessary for lock manufacturers to produce a range of locks. Locksmiths and architectural hardware suppliers must also carry a range of different locks. This can create problems, particularly where (as often) the different locks all use different mechanisms and components. In this situation, the lock manufacturer must be equipped to manufacture a very large range of different components in order to construct all the different locks, and locksmiths etc must carry and stock a large range of components and locks. This creates significant cost, stock handling difficulties and other problems for lock manufacturers, locksmiths and other architectural hardware suppliers. It would be preferable if a range of locks could be provided in which the basic components remain common (or mostly so) between the different locks in the range so as to minimise the number of different components that must be manufactured and handled. Naturally, higher end locks which provide a greater level of functionality and/or security may often need additional components to achieve this, but these additional components should preferably mostly "build on" the components of the lower level locks and substitution of low end lock components for alternative components in higher end locks should preferably be minimised.

In general, simple mortice locks which provide a relatively low level of security typically have only one bolt (typically a latch bolt) which extends out from the lock to engage with the strike/doorframe to maintain the door closed. Retracting this latch bolt allows the door to be opened. In order to properly be called a "lock" (as opposed to a non-lockable "latch"), the lock should incorporate some mechanism which can prevent retraction of the latch bolt (or at least prevent use of the handle to retract the latch bolt). Often, this mechanism will incorporate a key cylinder.

More secure locks often have multiple bolts. Most typically there will be 2 bolts—one latch bolt and one deadbolt. Both bolts need to be retracted in order to open the door. Normally, when the door is closed, only the latch bolt will automatically extend out to engage with the strike or doorframe to maintain the door closed (this automatic extension of the latch bolt when the door is closed is often called "self-latching"). However, if desired, the user can also operate the lock (typically by using a key cylinder) to extend the deadbolt and this generally deadlocks the lock.

Furthermore, even higher-end locks often operate as part of a multipoint lock assembly. These locks typically incorporate a latch bolt and deadbolt as just described, but they also have one or more remote bolts which are located above and/or below the main lock. Each remote bolt can be extended out to engage with a separate part of the doorframe to provide additional security.

Mortice locks have been provided which have a range of different operating modes. For the purposes of this specification, it is useful to describe three different modes. Importantly, not all mortice locks necessarily have all of these modes. Also, the function of some mortice locks may not accord precisely with the following description (i.e. some locks may have modes which do not exactly fit the description of some/any of the modes given below).

One of the modes may be referred to as the "passage mode". In the passage mode, it is possible to operate the door handle on either side of the door to open the door. Another mode may be referred to as the "safety mode". In the safety mode, a key is required to open the door from the outside (i.e. it is not possible to open the door from the outside simply by operating the door handle without first operating the lock with a key). However, in the safety mode the key is not necessarily required to open the door from the inside. In other words, in the safety mode, it is possible to operate the lock from the inside to allow the door to be opened without the need for a key. Finally, the third mode may be referred to as the "secure mode" or the "deadlocked" mode. In the secure mode, a key is required to open the door from either side (i.e. it is not possible to open the door from either side without first operating the lock with a key).

One particular mortice lock is described in Australian Patent Application No 2004229071. The lock described in Application 2004229071 is a fairly high end lock. It has a latch bolt, a deadbolt, and a pair of "shoot bolts" which can extend out from the top and bottom of the lock respectively to operate upper and lower remote bolts.

The latch bolt, deadbolt and shoot bolts are all operated by the door handle in Application 2004229071. The handle connects (via a spindle) to a drive cam, which in turn connects to a drive gear. The drive cam pivots coaxially with the drive gear about the axis of the spindle, but there is a degree of free pivotal motion between the drive cam and drive gear. The drive cam has a portion which engages directly with the latch tongue such that rotation of the drive cam from its neutral position in one direction (a first direction) causes linear retraction of the latch tongue. Hence, when the lock is in the passage mode, it is possible to rotate the handle(s) in that first direction which then rotates the drive cam thereby retracting the latch tongue. However, rotating the handle(s) and retracting the latch tongue in this way does not cause the drive gear to rotate (due to the free motion mentioned above).

When the lock in Application 2004229071 is in the passage mode, it is also possible to rotate the door handle(s) from the neutral position in the other direction (i.e. a second direction). Rotating the handle in the second direction does not cause any interaction between the drive cam and the latch bolt, so the latch bolt remains extended. However, rotating the handle(s) in the second direction causes the drive cam to rotate the drive gear (both rotate coaxially in the second direction). The drive gear has a series of teeth which mesh with corresponding teeth on the pivotable deadbolt. Consequently, rotating the handle in the second direction causes the drive gear teeth to pivot the deadbolt extending it out of the lock (i.e. this "throws" the deadbolt).

Throwing the deadbolt in Application 2004229071 in the way described in the previous paragraph also has the effect of extending the shoot bolts mentioned above. The shoot bolts each have a slot which attaches to a lug on the pivotable deadbolt. The lug to which the upper shoot bolt attaches is located forward of the deadbolt's pivot point, and the lug to which the lower shoot bolt attaches is located behind the deadbolt's pivot point. Consequently, as the deadbolt rotates out of the lock, this rotation pushes the upper shoot bolt upwards in the lock, and the lower shoot bolt is pushed downwards. This causes the respective shoot bolts to extend from the top and bottom of the lock to operate the remote bolts (the remote bolts connect to the shoot bolts by connecting rods). When the shoot bolts are thus extended, a portion on the upper shoot bolt engages with the extended latch bolt preventing the latch bolt from being retracted (either by using the handles or in an unauthorised manner using jemmy etc) while the shoot bolts (and deadbolt) are extended.

In Application 2004229071, if it is desired to retract the shoot bolts (and hence the remote bolts) and deadbolt, this can be done simply by rotating the door's handle in the first direction (assuming the lock is not "deadlocked" as described below).

Rotating the door's handle back in the first direction causes the drive cam to rotate the drive gear (both rotate in the first direction) and the teeth on the drive gear mesh with the teeth on the deadbolt to rotate the deadbolt back into the lock. This reverse rotation of the deadbolt causes the lugs on the deadbolt to pull the shoot bolts back into the lock.

The lock in Application 2004229071 also has a deadlock member. The deadlock member can only be operated using a key, and then only when the deadbolt has been thrown (which also extends the shoot bolts—as described above). The deadlock member cannot be operated when the deadbolt is retracted into the lock because, in this position, a curved ridge on the deadbolt presses against the deadlock member to prevent any movement of the deadlock member in the lock. However, when the deadbolt is thrown, the curved ridge moves out of the way of the deadlock member.

The reason it is only possible to operate the deadlock member using a key is because the deadlock member has a spring-loaded component which engages on one side of an internal ridge on the lock casing (the ridge is actually on the inside of the lock's cover plate). This prevents the deadlock member from moving in the deadlocking direction. The only way to disengage the spring-loaded component from this ridge is by turning a key in the key cylinder which causes the key cylinder's cam to initially push the spring-loaded component (against the spring bias) out of engagement with the ridge so it can move past the ridge. Further rotation of the key (and hence the cylinder cam) pushes the deadlocking member upwards in the lock into the deadlocked position. In the deadlocked position, a portion of the deadlock member engages with the drive cam to prevent rotation of the drive cam. Hence, when the lock is thus "deadlocked" (i.e. placed in the secure mode), it is not possible to rotate the handle(s) in the first direction to withdraw the latch bolt, deadbolt or shoot bolts. A key is therefore required to operate the lock from either side. Also, when the deadlock member moves into this deadlocking position, the spring-loaded component engages on the other side of the above-mentioned internal ridge thereby preventing the deadlock member from moving back towards the un-deadlocking position except if the key is again used to push the spring-loaded component out of engagement with the ridge and slide the deadlock member back into the un-deadlocking position.

Whilst the lock in Application 2004229071 is able to be used in a multipoint lock assembly that provides a high level of security, it has a number of limitations in terms of functionality. For instance, it isn't possible to operate the key to deadlock the lock unless and until the handle has been operated to throw the deadbolt and extend the shoot bolts. Also, the deadbolt and shoot bolts are extended and retracted together. It would be preferable if the lock could be operated to extend one or the other of the deadbolt and shoot bolts independently, or so that the lock can have both extended together, as desired. Furthermore, assuming the lock in Application 2004229071 has a key cylinder into which a key can be inserted from either side of the door (as normal), the operation of the lock is identical from either side. That is, the lock is either in the passage mode in which it is possible to operate the handle from either side to retract the latch bolt or throw the deadbolt and shoot bolts, or it is in the secure ("deadlocked") mode in which case a key is required to operate the lock from either side. The lock does not provide a safety mode in which a key is required to operate the lock from the outside but not necessarily from the inside.

The lock in Application 2004229071 also has shortcomings in terms of its versatility and its ability to be converted or adapted to create a lower level (less secure) lock. Indeed, it would be very difficult to adapt the lock for use as a single point lock (i.e. a lock with only the latch bolt) because the entire locking mechanism in Application 2004229071 involves the operation of the pivotable deadbolt. It would even be difficult to adapt the lock for use as two point lock (i.e. a lock having a latch bolt and a deadbolt but in which there is no need for the shoot bolts to operate the remote bolts) because removing the shoot bolts from the lock in Application 2004229071 would require the lower end of the deadlock member (and possibly also lower end of the lock casing) to be reconfigured, and a new mechanism would also be required for preventing the latch bolt from retracting when the lock is deadlocked (as noted above, this is presently achieved by a portion on the upper shoot bolt which engages with the latch bolt when the upper shoot bolt is extended).

It is an object of the present invention to help to address one or more of the above-mentioned disadvantages, or at least provide a useful or commercial alternative to mortice locks currently available in the marketplace.

It will be clearly understood that mere reference herein to previous or existing locks or other information (including publications) or problems does not constitute an acknowledgement or admission that any locks, other material(s) or information of any kind, or problems, or any combination thereof, formed part of the common general knowledge in the field, or is otherwise admissible prior art, whether in Australia or any other country.

DESCRIPTION OF THE INVENTION

In one form, the present invention resides broadly in a mortice lock having a lock casing which provides a first point of entrapment and a second point of entrapment, a latch bolt which can move between a latching position and an un-latching position, a handle for moving the latch bolt between the latching position and the un-latching position a key cylinder, an operating assembly that can move between a first position in which a deflectable portion of the operating assembly engages with the first point of entrapment and a second position in which the deflectable portion engages with the second point of entrapment, wherein only the key cylinder can move the operating assembly between the first position and the second position, and a locking member (which is not a shoot bolt or part thereof) that can move between a locking position in which a portion of the locking member engages with the latch bolt to prevent the latch bolt from moving into the un-latching position, and an unlocking position in which the latch bolt can move into the un-latching position wherein the locking member is operatively associated with the operating assembly such that moving the operating assembly into the first position moves the locking member into the unlocking position and moving the operating assembly into the second position moves the locking member into the locking position.

Most of the lock's components will be contained within the lock casing. The casing may therefore be thought of as forming the shell or enclosure (or at least a partial shell or enclosure) around the lock's internal mechanisms, although it will be appreciated that the casing will have a number of openings to allow components to extend out from the lock, and to allow other components to insert into or engage with and operate the lock. When assembled, the casing will typically have an overall rectangular box-like shape. Preferably, the casing will be longer in its vertical dimension (the dimension parallel to the side edge of the door) and shorter in its horizontal dimension (the dimension parallel to the inside/outside faces of the door) so that it can be inserted into a shallower cavity or "mortice" in the side edge of a door. The thickness of the casing will typically be less than the vertical or horizontal dimensions. It is preferable to minimise the thickness of the casing so that the lock can be inserted into a thinner "mortice", although the minimum thickness may be limited by the minimum thickness of certain components required to achieve the necessary strength and durability.

The casing will typically be made of metal, although no absolute limitation is to be implied regarding the material from which the casing can be made. Also, it is envisaged that the casing will often be made from two (or possibly more) components which may be brought together to form the casing and house the internal components. If there are two components that form the casing, these may be a body and a cover plate. The body may comprise an open sided receptacle into which the lock's internal components can be assembled, and the cover plate may be placed over the body's open side (or at least over one open side of the body) to "close" the casing and securely mount the lock's internal components inside.

The body and cover plate may be provided with shaped portions, cutouts, sculptings, folds and other features that can enable the internal components to be mounted and operate inside the casing. Some of the lock's internal components may even have a functional interaction with the casing (i.e. with the body or the cover plate or both, or some other part of the casing) in the operation of the lock.

In some embodiments, the body may be cast (or diecast) from a metal such as a zinc alloy, and the cover plate may be made from metal sheet or plate such as folded steel sheet. Both components may be machined or otherwise processed to provide the shaped portions, cutouts, sculptings, folds and other features mentioned above, as well as the desired finish.

The casing provides points of entrapment with which the deflectable portion of the operating assembly can engage. There will be at least a first and a second point of entrapment, although it will be understood that there could possibly also be additional points of entrapment. Nevertheless, the invention will be described with reference to the first and second points of entrapment only.

The points of entrapment may be formed by shaped portions, cutouts, sculptings, folds or other features (or a combination thereof) on the body or on the cover plate (or both), or on some other part of the lock casing. The points of entrapment may take any suitable form or configuration, and the first point of entrapment need not necessarily take the same form or configuration as the second point of entrapment.

In certain envisaged embodiments of the invention, each point of entrapment may be formed by part of a "C"-shaped or "["-shaped (or equivalently "]"-shaped) feature. (hereinafter "["-shaped feature). The "["-shaped feature(s) may be formed in either the body or the cover plate, or there may be "["-shaped features in both. Each "["-shaped feature may take the form of a "["-shaped cutout in the body/cover plate, or alternatively the body/cover plate may contain a "["-shaped recess, indent, groove or something of a similar nature. It should be noted that whilst reference will be made primarily to "["-shaped feature(s) in this specification, each point of entrapment may alternatively be formed by a feature or features having (an)other shape(s) wherein the shape(s) do(es) not prevent the operating assembly from moving between the first and second positions and the shapes allow the deflectable portion of the operating assembly to engage with and move between the respective points of entrapment.

Each "["-shaped feature may be oriented vertically such that the two horizontal portions of the "[" shape, and in particular the terminating ends thereof, form upper and lower horizontal points of entrapment respectively, and such that the "|" shaped part of the "[" connects the upper and lower horizontal portions. However, this is not to say that embodiments could not be made in which the "["-shaped feature(s) are oriented horizontally or in some other orientation. Nevertheless, if it/they are oriented vertically as described at the beginning of this paragraph, the upper horizontal portion(s) may define the first point of entrapment (hereinafter referred to as the upper point of entrapment), and the lower horizontal portion(s) may define the second point of entrapment (hereinafter referred to as the lower point of entrapment). Hence, the deflectable portion of the operating assembly may engage with (and preferably insert into) the upper point of entrapment when it is in the first position, and when it is in the second position it may engage with (and preferably insert into) the lower point of entrapment.

The lock also has a latch bolt which can move between a latching position and an unlatching position. In the latching position, the latch bolt extends out from within the lock such that, if the door is closed, the latch bolt engages with the doorframe or a strike associated with the doorframe to prevent the door from being opened. The latch bolt can be retracted back into the lock so that the latch bolt disengages from the strike or doorframe and thereby allows the door to be opened. The position of the latch bolt when it is retracted back into the lock sufficiently for the door to be opened is the un-latching position.

The latch bolt is retracted from the latching position into the un-latching position by using the handle. The handle can take any suitable form which the user can grasp by hand and operate to retract the latch bolt. It is envisaged that the handle will typically comprise a lever type door handle, although a door knob or other type of actuating handle could also be used and no limitation is to be implied in relation to the form that the handle may take. The lock may in fact have two handles, one on the outside and one on the inside. If there are two handles, either handle may be used to retract the latch bolt in order to open the door, at least when the lock is in the passage mode. The inside handle need not necessarily take the same form or configuration as the outside handle.

It is envisaged that the latch bolt will typically be a linearly reciprocating latch bolt of the general kind normally used on swinging doors. Therefore, the latch bolt will typically be one that slides linearly between the latching and unlatching positions.

The reciprocating latch bolt may have a sloping or bevelled portion on the end of the latch bolt which projects out from the lock. This arrangement is quite conventional and operates such that as the door is closed the sloped/bevelled portion engages with the strike or doorframe. The slope of the bevelled portion then causes the latch bolt to be forced back into the lock as the door is pushed closed thereby allowing the latch bolt to move past the strike or door jam/doorframe. This in turn allows the door to fully close. When the door is fully closed, the latch bolt can again extend out into the latching position to maintain the door closed.

The latch bolt may be biased towards the extended latching position, typically (although not necessarily) by way of a spring. This is so that after the latch bolt has been pushed back into the lock by contact with the strike or door jam as the door is closed, it then automatically extends back out to engage in the strike or door jam to maintain the door closed. In this way, the lock may be "self-latching".

The latch bolt may also be assembled from a number of components which together form a latch bolt assembly; although this is not to say that the latch bolt could not also be a single component such as a diecast or machined component. In either case, the latch bolt will preferably be constructed from a strong and durable material such as metal. If the latch bolt comprises a multi-component latch bolt assembly, one of the components may form the sloped or bevelled outer end portion of the latch bolt. Another component may comprise an inner portion of the latch bolt with which the handle is linked (typically, but not necessarily, via other internal component of the lock) such that operating the handle retracts the latch bolt from the latching position to the un-latching position. The latch bolt assembly may also comprise further components, such as one or more spacers or "packers" for allowing selective adjustment of the latch bolt length, a sound dampening component for dampening the noise created by contact between the bevelled portion of the latch bolt and the strike or doorframe, and one or more fasteners to hold the latch bolt assembly together.

The handle(s) may be biased so that after the user has operated the handle (or one of them) to retract the latch bolt and then let go of the handle, the handle(s) return(s) to the neutral (i.e. un-operated) position. Where the handle is a lever type door handle, the neutral position may be where the handle is oriented horizontally, although this is not critical. Any suitable means may be used for biasing the handle(s) towards the neutral position. A spring or sprung assembly may be provided in the lock to achieve this. Alternatively, a spring or sprung mechanism may be provided outside the lock, for example in the lock furniture, to bias the handle(s) to the neutral position. It is envisaged that a sprung "shuttle" mechanism assembled inside the lock furniture, such as the one disclosed in our Australian Patent Application No 2007201170, will typically be used.

The lock of the present invention incorporates a key cylinder. It is envisaged that the key cylinder will generally be of the conventional kind into which a key can be inserted and turned, and wherein turning the key causes a cam associated with the cylinder to pivot about the principal cylindrical axis of the cylinder. In other words, turning the key in the cylinder causes the cylinder cam to move in an arcuate path around the key cylinder. The key cylinder may be able to receive a key from either side, or more typically both sides, of the door. Alternatively, the key cylinder may be configured so that the key can be inserted from one side only (typically the outside), and the cylinder may have a permanent knob or other member on the other side (typically the inside) to allow the key cylinder to be operated from that other side without the need for a key.

As described above, the lock incorporates an operating assembly that can move between a first position in which a deflectable portion of the operating assembly engages with the first point of entrapment and a second position in which the deflectable portion engages with the second point of entrapment. As also described above, in some embodiments the first point of entrapment may comprise one or more upper horizontal portions of one or more vertically oriented "["-shaped features, and the second point of entrapment may comprise one or more lower horizontal portions of one or more vertically oriented "["-shaped features. Thus, it follows that the first position of the operating assembly may be an upper position, and the second position of the operating assembly may be a lower position. Suitably, the operating assembly may be configured for vertical linear sliding motion inside the lock.

The operating assembly may include a main component which moves vertically in the lock between the first and second positions. The deflectable portion may be part of the main component, or it may be a separate component which is assembled to the main component, and it may move vertically with the main component. However, the deflectable portion may also be able to move laterally between positions which are un-deflected and deflected relative to the main component. The deflectable portion will preferably be biased towards the un-deflected position. This may be achieved by the inherent resilience of the deflectable portion, or alternatively by means of a spring or the like.

The deflectable portion of the operating assembly may have one or more parts or portions thereof (each hereinafter referred to as an "insert") which insert into the "["-shaped feature(s). In some embodiments, there may be one "["-shaped cutout in the lock's cover plate, and another "["-shaped cutout in the lock's body, and the deflectable portion of the operating assembly may have respective inserts which insert into each of those "["-shaped cutouts. Each insert may take the form of a lug projecting from the deflectable portion, although the inserts may alternatively take other forms or configurations. Hence, the form of the inserts is not critical and one insert may be have a different form or configuration to the other insert.

In the embodiments described in the previous paragraph, when the operating assembly is in the first position, the inserts are positioned in the upper points of entrapment and the deflectable portion is normally in the un-deflected position, thus pushing the inserts into the closed ends of the upper points of entrapment. In other words, in the first position of the operating assembly, the inserts on the deflectable portion are positioned in the closed-off ends of the upper horizontal portions of each of the "["-shaped cutouts. Conversely, when the operating assembly is in the second position, the inserts are positioned in the lower points of entrapment and the deflectable portions will normally be in the un-deflected position, thus pushing the inserts into the closed ends of the lower points of entrapment.

When the deflectable portion of the operating assembly is in the un-deflected position pushing the inserts into the closed ends of the points of entrapment (upper or lower), the operating assembly is prevented from moving from the first position to the second position or vice versa (except by operating the key cylinder as described below) because the inserts engage against the material of the cover plate and base located in between the two horizontal portions of each "[".

However, the key cylinder may be used to disengage the deflectable portion from the relevant point of entrapment and move the operating assembly between the first position and the second position. The key cylinder's cam may be the only component in the lock which is able to move the deflectable portion of the operating assembly from its un-deflected position into its deflected position. This may be why the operating assembly can only be moved between the first and second positions using the key cylinder.

Operating the key cylinder with the key may cause the cylinder cam to push against the deflectable portion, thus moving the deflectable portion from the un-deflected position into the deflected position. This may move the inserts out of the closed-off ends of the points of entrapment and into the vertical "|"-shaped portions of the respective "["-shaped features. This may in turn "disengage" the deflectable portion and thereby allow the main component of the operating assembly to move vertically in the lock. So, after the deflectable portion has been disengaged, rotation of the key may cause the cylinder's cam to push the main portion of the operating assembly up or down (depending on the direction in which the key is turned), thus pushing the operating assembly up from the second position to the first position or down from the first position to the second position. The cam may contact the main component directly to push it up and down. When the key is turned so that the cylinder cam moves out of engagement with the operating assembly, the deflectable portion may then move back into the un-deflected position under its bias, thus re-engaging the inserts with the point of entrapment (upper or lower) to again prevent movement of the operating assembly.

The lock also has a locking member that can move between a locking position and an un-locking position. In the locking position, a portion of the locking member engages with the latch bolt to prevent the latch bolt from moving into the un-latching position. Conversely, in the un-locking position the latch bolt can move into the un-latching position. It has been explained that the locking member is operatively associated with the operating assembly such that moving the operating assembly into the first position moves the locking member into the unlocking position and moving the operating assembly into the second position moves the locking member into the locking position.

Importantly, the locking member is not a shoot bolt or a portion of a shoot bolt. In the present specification, a "shoot bolt" is a component the movement of which operates a remote bolt. The locking member in the present invention is a component which does not fall within this definition. The present invention can therefore be embodied in locks which do not necessarily have shoot bolts or remote bolt mechanisms. Consequently, locks in accordance with the present invention may form "stand-alone" one point or two point locks, as well being able to form the central lock in multipoint lock assemblies. This is quite different to locks such as the one described in Australian Patent Application No 2004229071 which necessarily have shoot bolts.

The locking member preferably includes a blocking portion which engages with the latch bolt when the locking member is in the locking position to prevent the latch bolt from retracting. This may be achieved in a wide range of ways, all of which are considered to potentially fall within the scope of the present invention. Preferably, the blocking portion may prevent the latch bolt from retracting when the locking member is in the locking position by directly contacting with the latch bolt if an attempt is made to retract the latch bolt. Where the latch bolt is linearly reciprocating latch bolt, the blocking portion may become positioned directly behind the rear of the latch bolt when the locking member is in the locking position such that any attempt to retract the latch bolt causes the rear of the latch bolt to collide with the blocking portion.

The locking member is operatively associated with the operating assembly such that moving the operating assembly into the first position moves the locking member into the unlocking position and moving the operating assembly into the second position moves the locking member into the locking position. This operative association between the locking member and the operating assembly may be achieved in any suitable way. For example, in some embodiments, the locking member may be directly connected to the main portion of the operating assembly such that moving the main portion of the operating assembly up and down in the lock (as described above) moves the locking member between the second and first positions respectively. This direct connection between the main component of the operating assembly and the locking member may be used particularly where the present invention is embodied in a relatively simple low end lock (such as a single point lock). Alternatively, the movement of the operating assembly may be linked to that of the locking member via an intermediate mechanism. Intermediate mechanisms such as this for linking the movement of the operating assembly to the movement of the locking member may be used particularly where the present invention is embodied in higher end locks, such as two-point and multipoint locks.

One type of intermediate mechanism that may be used to link the movement of the operating assembly to the movement of the locking member may be a deadlock mechanism. The deadlock mechanism may comprise a component, or a series of inter-operating components, which link(s) the movement of the operating assembly with the movement of the locking member. The deadlock mechanism may also be associated with a deadbolt such that operating deadlock mechanism also operates a deadbolt. Hence, in these embodiments the lock may be a two-point lock wherein the two "points" are the latch bolt and a deadbolt. The deadbolt may be moved by the deadlock mechanism between a retracted position in which it does not extend out from the lock, and a thrown position in which it extends out from the lock.

The deadlock mechanism may include a linking member. The linking member may be a rigid component that attaches to the main component of the operating assembly and also to the deadbolt such that movement of the operating assembly is transferred via the linking member to the deadbolt. Suitably, moving the operating assembly from the first position to the second position (by using the key as described above) may move the deadbolt from the retracted position to the thrown position. In other words, turning the key to move the operating assembly from the first position to the second position may throw the deadbolt. Conversely, turning the key to move the operating assembly from the second position to the first position may retract the deadbolt.

From above, it may be recalled that it is only possible to move the operating assembly between the first and second positions using a key. It follows from this that it is also only possible to throw and retract the deadbolt using the key. When the deadbolt is thrown while the door is closed, the deadbolt engages with a recess in the strike or doorframe to prevent the door from being opened. The only way to then open the door is to first use the key to retract deadbolt. Consequently, when the deadbolt is thrown, the lock may be considered to be in the secure ("deadlocked") mode.

Turning again to the deadlock mechanism, it will be recalled that the deadlock mechanism is a mechanism that may be used to link the movement of the operating assembly to the movement of the locking member, and that the deadlock mechanism may incorporate a linking member. The locking member may connect to the linking member, or to an additional component of the deadlock mechanism associated with the linking member, such that movement of the operating assembly is transferred via the linking member or the additional component to the locking member. Suitably, moving the operating assembly from the first position to the second position (by using the key as described above) may move the locking member from the unlocking position to the locking position. In other words, turning the key to move the operating assembly from the first position to the second position may secure the latch bolt against retraction in addition to throwing the deadbolt. Conversely, turning the key to move the operating assembly from the second position to the first position may move the locking member to the unlocking position where in the latch bolt can retract into the lock, as well as retracting the deadbolt.

In some envisaged embodiments, the linking member may be a pivoting component wherein vertical sliding movement of the operating assembly (as described above) causes the linking member to pivot. Also, the deadbolt may move in a linear horizontal manner between the retracted position and the thrown position, and the locking member may move in a linear vertical fashion between the locking and unlocking positions. Hence, the vertical sliding movement of the operating assembly may cause the linking member to pivot, which may in turn cause horizontal linear movement of the deadbolt and vertical linear movement of the locking member. Thus, to rephrase what was said above, turning the key to move the operating assembly from the first position to the second position may have the effect of throwing the deadbolt to convert the lock into the secure mode, as well as moving the locking member into the locking position to prevent retraction of the latch bolt.

The lock may incorporate a hub assembly. The hub assembly may include one or more components ("hubs") which are mounted for pivotal movement in the lock. The hubs may be rigidly linked to the handle(s) (typically, but not necessarily, via a spindle of square cross-section). Hence, when the handle(s) rotate, the hubs may rotate in the same direction and to the same extent. Conversely, if the handle(s)/hubs are prevented from rotating (or from rotating past a particular point in a certain direction), then the hubs/handle(s) will be similarly prevented from rotating (or from rotating past the said point in the said direction). As explained above, the handle(s) has an un-rotated "neutral" position. Where the hubs are rigidly linked to the handle(s), it follows that when the handle (s) are in its neutral position the hubs also adopt a corresponding un-rotated "neutral" position.

The hub assembly may also incorporate a drive member. The hubs may be configured such that some rotation of the hubs causes rotation of the drive member, although the drive member may also have a degree of "free movement" such that there is some rotation of the hubs which does not cause rotation of the drive member. More specifically, the hub assembly may be configured such that rotating the hubs (by rotating the handle) in one direction (the first direction) from the neutral position causes the drive member to rotate in that direction to the same extent, but rotating the hubs (again by rotating the handle) in the other direction (the second direction) from the neutral position does not cause any rotation of the drive member. Suitably, the first direction is the direction in which the handle/hubs may be rotated to retract the latch bolt.

The drive member may engage with the latch bolt such that rotation of the drive member in the first direction from the neutral position retracts the latch bolt. From above, it will be appreciated that the drive member may be rotated in this way by rotating the handle in the first direction which causes corresponding rotation of the hubs, which in turn rotates the drive member.

The lock may also incorporate a snib mechanism. The snib mechanism may be operable via a snib lever which is accessible from the inside of the door. It may be possible to engage and disengage the snib mechanism using the snib lever. The snib lever may take any suitable form or configuration that can be operated by hand, although it is envisaged that it will typically be a small pivotable lever. It may also be possible to disengage the snib mechanism by operating the key cylinder. If a key can be inserted into the cylinder from either side of the door, it may be possible to disengage the snib-mechanism using the key cylinder from either side of the door.

The snib mechanism may operate to convert the lock between the passage mode and the safety mode. Hence, when the snib mechanism is disengaged (i.e. when the lock is "un-snibbed") it may be possible to use either the inside handle or the outside handle (if present) to retract the latch bolt. However, when the snib mechanism is engaged (i.e. when the lock is "snibbed"), the lock cannot be operated from the outside unless a key is first inserted from the outside of the door and turned to disengage the snib mechanism thereby returning the lock to the passage mode. If the snib mechanism is engaged, the lock may be operated from the inside without the need for a key by first operating the snib lever to un-snib the lock thus returning it to the passage mode.

The snib mechanism may incorporate the snib bar, which may be a component inside the lock (although it could possibly also be outside the lock—for example in the lock furniture etc). If it is in the lock, the snib bar may be configured to move in a vertical linear fashion between an engaged "snibbing" position and a disengaged "un-snibbing" position. The snib bar may be moved between these positions by operating the snib lever. Suitably, moving the snib lever in one way may cause the snib bar to move into the snibbing position and moving the snib lever in another way (typically, but not necessarily, the opposite way) may cause the snib lever to move into the un-snibbing position.

Suitably, the snib bar may engage with the hub assembly when it is moved into the snibbing position to prevent the hubs from rotating from the neutral position in the first direction. Preventing the hubs from rotating from the neutral position in the first direction may also prevent the handles from moving in that way. Therefore, this may prevent the handles from being used to retract the latch bolt when the snib mechanism is engaged (i.e. this may be how the snib mechanism converts the lock into the safety mode). However, when the snib bar moves into the un-snibbing position it may not engage with the hub assembly and the hub assembly may be free to move from the neutral position in the first direction (thus placing the lock in the passage mode).

It should be noted that the snib mechanism may not prevent the hubs (and hence the handle(s)) from rotating from the neutral position in the second direction. In other words, it may be possible to rotate the handles (and hence the hubs) from the neutral position in the second direction irrespective of whether the snib mechanism is engaged or not. Furthermore, rotating the handle(s) (and hubs) in this way may not move the hub assembly's drive member because of the drive member's "free motion". Hence, rotating the handle(s) from the neutral position in the second direction may not affect the latch bolt.

In embodiments of the lock which incorporate both a deadlock mechanism and a snib mechanism, the lock may be configured such that if the lock is in the safety mode (i.e. if the snib mechanism is engaged) but the deadbolt has not been thrown, then the action of operating the deadlock mechanism to throw the deadbolt may disengage the snib mechanism. Suitably, when the key is turned in the key cylinder, the key cylinder cam may engage with the snib bar to move the snib bar from the snibbing position to the un-snibbing position before the cam moves into engagement with the operating assembly to move the operating assembly from the first position to the second position.

The lock may also incorporate one or more shoot bolts to enable the lock to be used (generally as the central lock) in a multipoint block assembly. As explained above, a "shoot bolt" is a component of the lock the movement of which operates a remote bolt. Those skilled in this area will be familiar with a range of different forms and configurations of remote bolts. They will also be familiar with a range of different ways for connecting remote bolts to the shoot bolts of locks so that operation of the shoot bolts moves the remote bolts. Any remote bolt configuration and method for connecting the remote bolts to the shoot bolts may be used in the present invention. It is envisaged that connecting rods will typically be used to connect the shoot bolts to the remote bolts, but this is not critical.

It is envisaged that certain embodiments of the present invention may incorporate two shoot bolts, each operating a separate remote bolt. There may be an upper shoot bolt and a lower shoot bolt. Each shoot bolt may move in a vertical linear manner between a retracted position in which the associated remote bolt is not thrown, and an extended position in which the associated remote bolt is thrown. Suitably, the upper shoot bolt may move vertically upwards when moving from its retracted position into its extended position, and the lower shoot bolt may move vertically downwards when moving from its retracted position to its extended position. The shoot bolts may be functionally associated with the hub assembly so that the shoot bolts can be moved between their extended positions and their retracted positions by operating the handle (s).

At this point, it should be recalled that the handle(s) (and hence the hubs) may be able to rotate from the neutral position in the first direction in order to retract the latch bolt. However, the handle(s) and hubs may also be able rotate from the neutral position in the opposite direction (i.e. the second direction). Moving the handle(s) from the neutral position in the second direction may cause the shoot bolts to move from their retracted positions to their extended positions (unless the shoot bolts are already in their extended positions). To enable this, at least one of the hubs may engage with the shoot bolts such that when that hub rotates from the neutral position in the second direction, that rotation causes the associated shoot bolt to move in a vertical linear fashion from the retracted position to the extended position (assuming the associated shoot bolt was not already in its extended position). In some embodiments, one hub may engage with one of the shoot bolts, and the other shoot bolt may be linked to the first mentioned shoot bolt via a "seesaw" type rocker member. Thus, when the hub engages with the first mentioned shoot bolt to move it vertically up/down into its extended position, this vertical movement of the first mentioned shoot bolt may cause the rocker member to pivot like a seesaw thereby forcing the other shoot bolt down/up (i.e. the other shoot bolt may move in the opposite direction) into its extended position.

Embodiments of the lock which are provided with shoot bolts may also incorporate a shoot bolt retraction mechanism. The shoot bolt retraction mechanism may be associated with the hub assembly as well as with one or both of the shoot bolts. The shoot bolt retraction mechanism may operate such that, if the shoot bolts are in their extended positions, then when the handle(s) (and hence the hubs) are rotated from the neutral position in the first direction (i.e. the direction used to retract the latch bolt), this also operates the shoot bolt retraction mechanism to move the respective shoot bolts from their extended positions back into their retracted positions. To enable this, at least one of the hubs may engage with the shoot bolt retraction mechanism such that when that hub rotates from the neutral position in the first direction, that rotation causes the shoot bolt retraction mechanism to engage with at least one of the shoot bolts (if the shoot bolts are in their extended positions) moving said shoot bolt(s) from the extended position to the retracted position.

Again, in some embodiments, the shoot bolt retraction mechanism may engage with only one of the shoot bolts, and the other shoot bolt may be linked to the first mentioned shoot bolt via a rocker member. Thus, when the hub and shoot bolt retraction mechanism are operated to retract the first mentioned shoot bolt by moving that shoot bolt vertically upwards/downwards, this vertical movement of the first mentioned shoot bolt may cause the rocker member to pivot like a seesaw thereby forcing the other shoot bolt down/up to also return it to its retracted position.

If the lock incorporates a deadlock mechanism, the lock may further include a lock status indicator. The lock status indicator may function to provide a visual indication to the user as to whether or not the lock is in the secure "deadlocked" mode. Suitably, the lock status indicator may function to provide this visual indication on one side (i.e. so that it is visible from one side of the door), or from both sides. Preferably, the lock status indicator may function to provide the visual indication from at least the inside of the door.

Any suitable mechanical, electronic or electromechanical means capable of providing a visual indication as to whether or not the lock is in the secure mode may be used to form the lock status indicator. In certain envisaged embodiments, the lock status indicator may comprise non-electronic mechanical components. In these embodiments, the components of the lock status indicator may be mounted in the lock's furniture, although they may engage with internal components of the lock so that the indication changes when the lock converts from the passage or safety mode into the secure mode. In one form, the lock status indicator mechanism may comprise one or more indicating components. A part of the indicating component, or one of the indicating components if there is more than one, may be marked in a visually identifiable manner to indicate that the lock is not in the secure mode. This indicating component, or part of the indicating component which is marked to indicate the lock is not in the secure mode, may be referred to as the non-secure mode indicator. Another part of the indicating component, or one of the other indicating components if there is more than one, may be marked in a different visually identifiable manner to indicate that the lock is in the secure mode. This indicating component, or part of the indicating component, which is marked to indicate that the lock is in the secure mode may be referred to as the secure mode indicator. Suitably, the non-secure mode indicator may be coloured green, and the secure mode indicator may be coloured red. When the lock is in the secure mode, only the secure mode indicator may be visible from externally of the lock, and when the lock is not in the secure mode, only the non-secure mode indicator may be visible from externally of the lock. This may be how the lock status indicator provides a visual indication to the user as to whether or not the lock is in the secure mode.

The one or more indicating component(s) may be functionally linked with a deadlock mechanism such that when the deadlock mechanism operates to throw the deadbolt, this moves the indicating component(s) such that the non-secure mode indicator ceases to be visible from externally of the lock and the secure mode indicator becomes visible from externally of the lock. If the deadlock mechanism incorporate a linking member, the indicating component(s) of the lock status indicator may connect (either directly, or indirectly via intermediate component) with the linking component such that movement of the linking component causes the indicating component(s) to move to provide the correct indication of the lock's mode.

BRIEF DESCRIPTION OF THE DRAWINGS

Certain embodiments and features of the invention are described below by way of example and with reference to the drawings. However, it will be clearly appreciated that the ensuing descriptions are provided to assist in understanding the invention only, and the invention is not necessarily limited to or by any of the embodiments or features described.

In FIG. 8, the lock body and certain other components have been omitted.

In FIG. 9, the lock body and certain other components have been omitted.

FIG. 11 is a perspective exploded view of the cylinder cam operated locking mechanism assembly (called the Talon assembly).

FIG. 12 is a side view the Talon assembly when its various components are assembled together.

FIG. 13 is an exploded perspective view of the latch tongue assembly.

FIG. 14 is a side view of the latch tongue when its various components are assembled together.

FIG. 20 is an exploded perspective view of the three components that make up the hub assembly.

FIG. 21 is a side on view of the three components of FIG. 20 assembled together.

FIG. 22 is a perspective view of the snib actuator.

FIG. 23 is a side on view of the snib actuator.

FIG. 28 differs from FIG. 29 mainly in that the escutcheon has been removed in FIG. 28 for clarity.

FIG. 30 differs from FIG. 31 mainly in that the escutcheon has been removed in FIG. 30 for clarity.

DETAILED DESCRIPTION OF THE DRAWINGS

Figure 1:
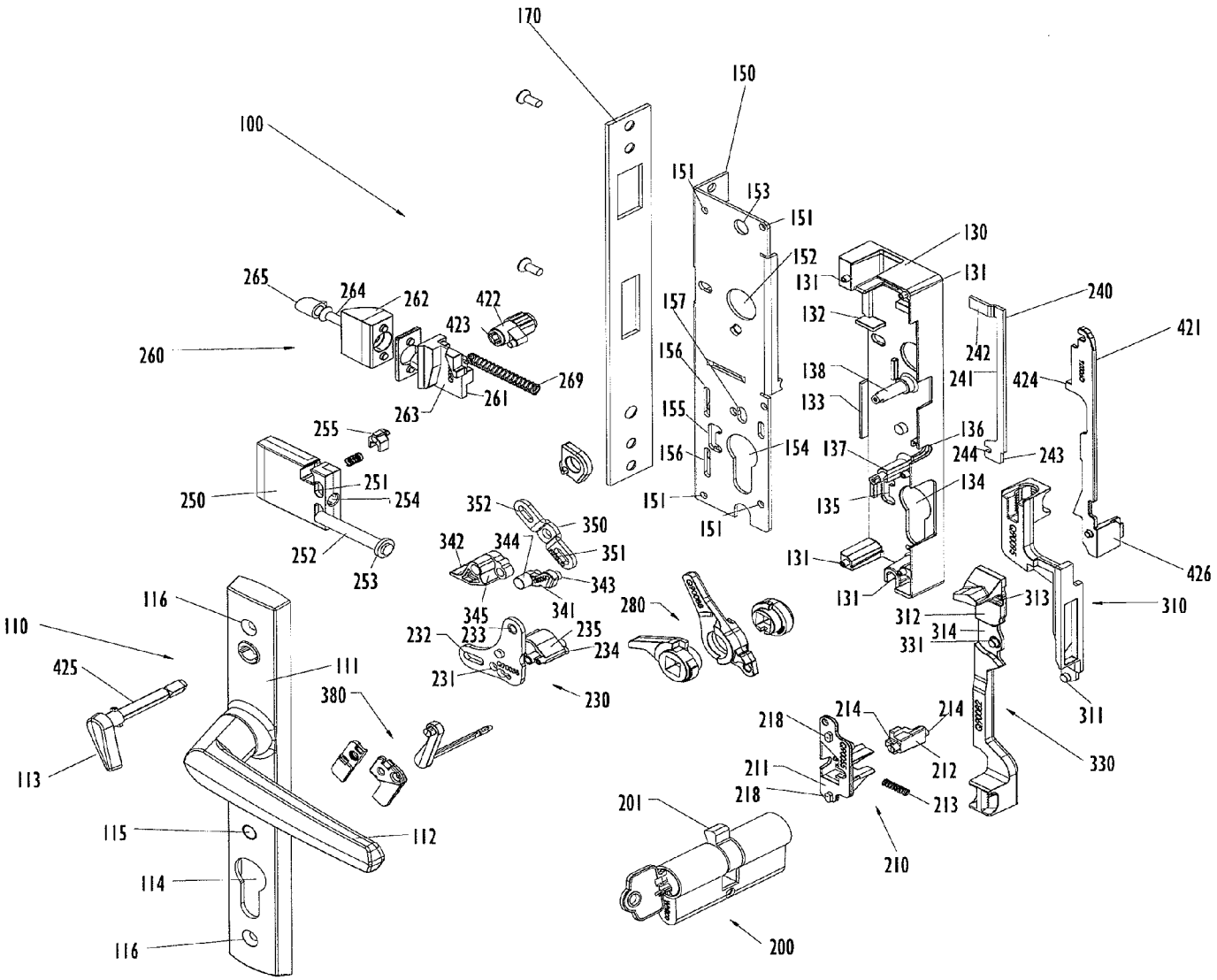
FIG. 1 is an exploded perspective view showing the various components of a lock in accordance with one embodiment of the invention.

The following description will focus primarily on one particular embodiment of the invention as shown in FIGS. 1-33. The embodiment in FIGS. 1-33 is a "premium" lock in that its mechanism is sophisticated and provides a large number of beneficial functions. The premium lock shown in FIGS. 1-33 is indicated generally by reference numeral 100. However, it will be appreciated that the invention can also be embodied in simpler locks (i.e. locks with less sophisticated mechanisms and functionality). To illustrate this point a simpler lock embodying the invention is shown in FIG. 34. This and other simpler locks embodying the invention will be briefly described towards the end.

It is convenient to introduce the various components of the lock 100 by referring to the exploded view in FIG. 1. From FIG. 1 it can be seen that the lock 100 incorporates the following principal components and subassemblies, the general operation of which are summarised in the respective adjacent paragraphs:

The Lock's Exterior Furniture 110

The furniture 110 incorporates the escutcheon 111, the lever handle 112, snib lever 113, aperture 114 for receiving a key cylinder etc as described further below. Only the furniture 110 which is positioned on the inside face of the door is shown in the Figures. However, it will be appreciated that the lock will also generally (although not necessarily) have furniture and a handle etc on the outside face of the door. The remainder of this description relates to locks which have an outside furniture (although the outside furniture is not pictured). The outside furniture will typically be very similar to the inside furniture (i.e. it will have an escutcheon, a lever handle, an aperture for receiving the key cylinder etc), however the outside furniture will not incorporate a snib lever 113 like the one shown associated with the inside furniture. Consequently, the lock's snib mechanism is operable only from the inside.

The Main Body 130 of the Lock Casing

The majority of the functional components of the lock are mounted within the body 130 as described below;

The Cover Plate 150

When the lock 100 is assembled, the cover plate 150 is positioned over the open side of the body 130 to contain the internal workings of the lock within the body. However, in addition to this, both the body 130 and the cover plate 150 also serve as structural and functional components of the lock 100 as will be described further below The Forend Plate 170 (Which Could Also be Called a 'Faceplate')

Whereas the inside and outside furniture form the visible exterior of the lock on the inside and outside faces of the door respectively (when the lock is assembled on the door), the forend plate 170 forms the exterior of the lock on the side edge of the door. The forend plate 170 has apertures to allow the latch tongue 260 and the deadbolt 250 to extend and retract through it. It also has screw holes to allow it to be mounted in position.

The Key Cylinder 200

The lock 100 uses a conventional key cylinder 200. A key can be inserted into the cylinder 200 from either the inside or outside of the door to rotate a cylinder cam 201 which in turn interacts with other internal components to operate the lock The Cylinder Cam Operated Locking Mechanism 210

The "operating assembly" in this embodiment takes the form of a cylinder cam operated locking mechanism. The cylinder cam operated locking mechanism is generally designated by reference numeral 210 and will be referred to as the "Talon" assembly. The Talon assembly 210 interacts with various internal components of the lock to move the deadbolt 250 when the key cylinder 200 is operated by a key.

The Locking Link 230

The locking link 230 interacts with a number of the lock's other mechanisms including the Talon assembly 210 and the lock status indicator assembly 380

The Deadbolt Assembly 250

When the deadbolt extends out from the lock to engage with a strike or the like in the doorframe, the lock is in the secure (deadlocked) mode. Conversely, in the safety and passage modes the deadbolt is retracted back into the lock.

The Latch Bolt Assembly 260

The latch bolt 260 may also be referred to as the latch tongue 260 (or simply the latch 260), and these terms may be used interchangeably. The latch bolt 260 can be retracted by the handle 112 when the lock is in the passage mode to allow the door to be opened.

The Hub Assembly 280

The hub assembly 280 interacts with the handle 112 to allow the latch tongue 260 to be retracted. However, the hub assembly 280 also interacts with many of the lock's other internal components to provide a range of additional functionalities The Shoot Bolts 300

The shoot bolts include an upper shoot bolt 310 and a lower shoot bolt 330. The shoot bolts can be connected to remote bolt operating rods to allow the lock to be used as the central lock in a multipoint lock assembly. If such rods and remote bolts are connected to the shoot bolts, extending the shoot bolts throws the remote bolts, and retracting the shoot bolts withdraws the remote bolts. The movement of the upper shoot bolt 310 is linked to that of the lower shoot bolt 330 by a shoot bolt rocker 350.

The Lock Status Indicator Assembly 380

The lock status indicator assembly 380 operates to visually indicate to the user whether or not the lock is deadlocked.

Figure 2:
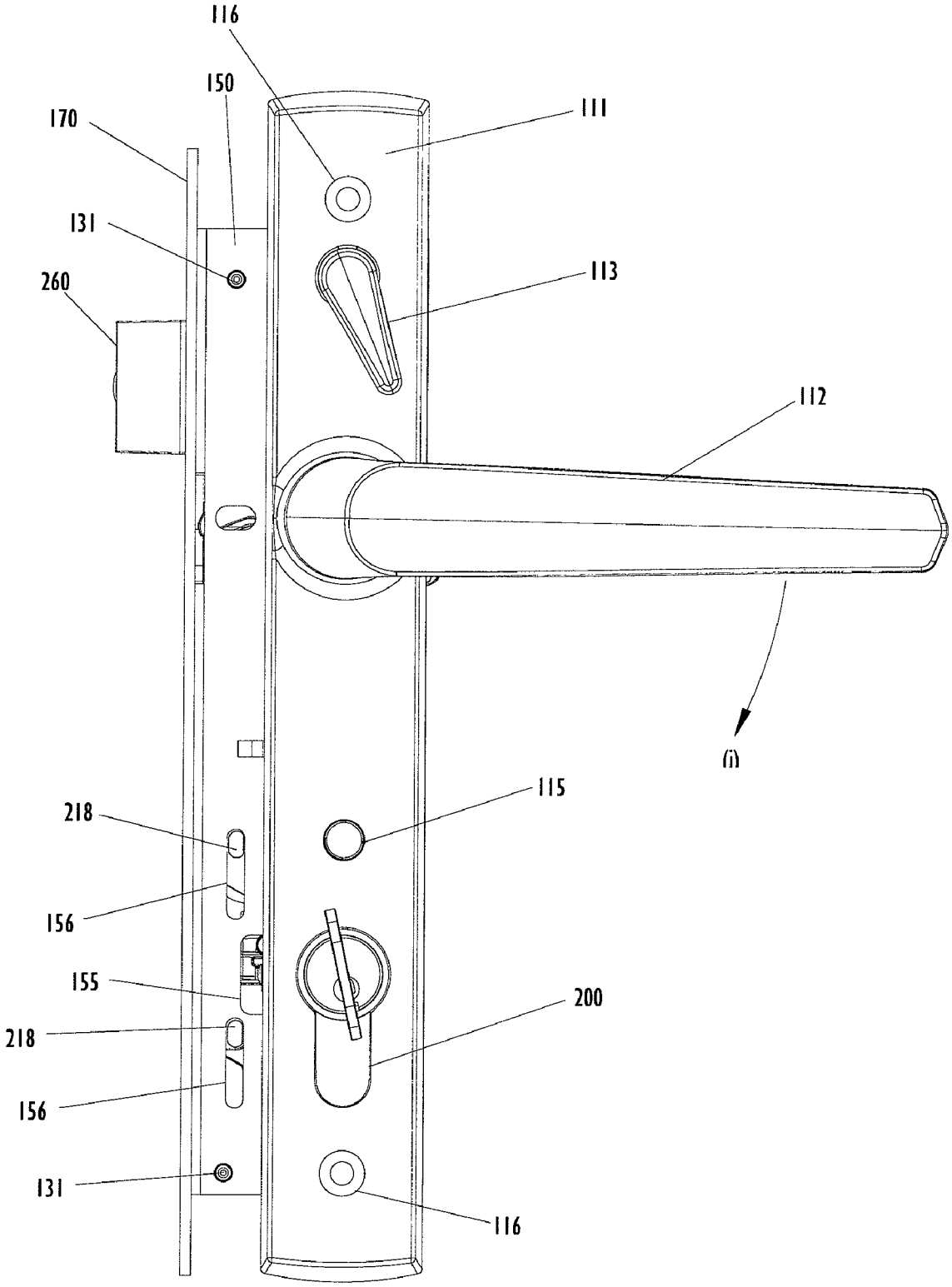
FIG. 2 is a side view of the lock in the "passage mode".
Figure 3:
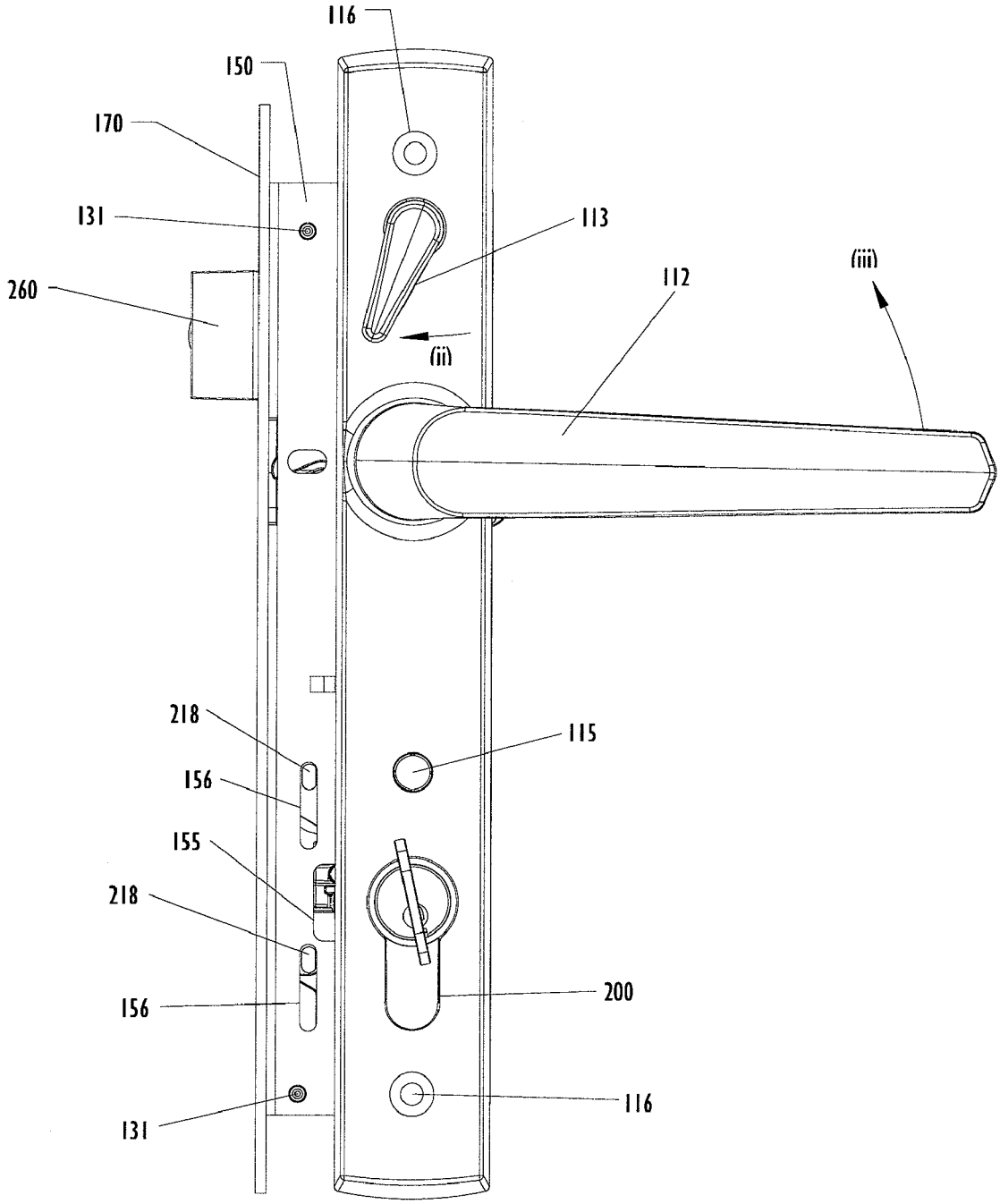
FIG. 3 is a side view of the lock into the "safety mode".
Figure 4:
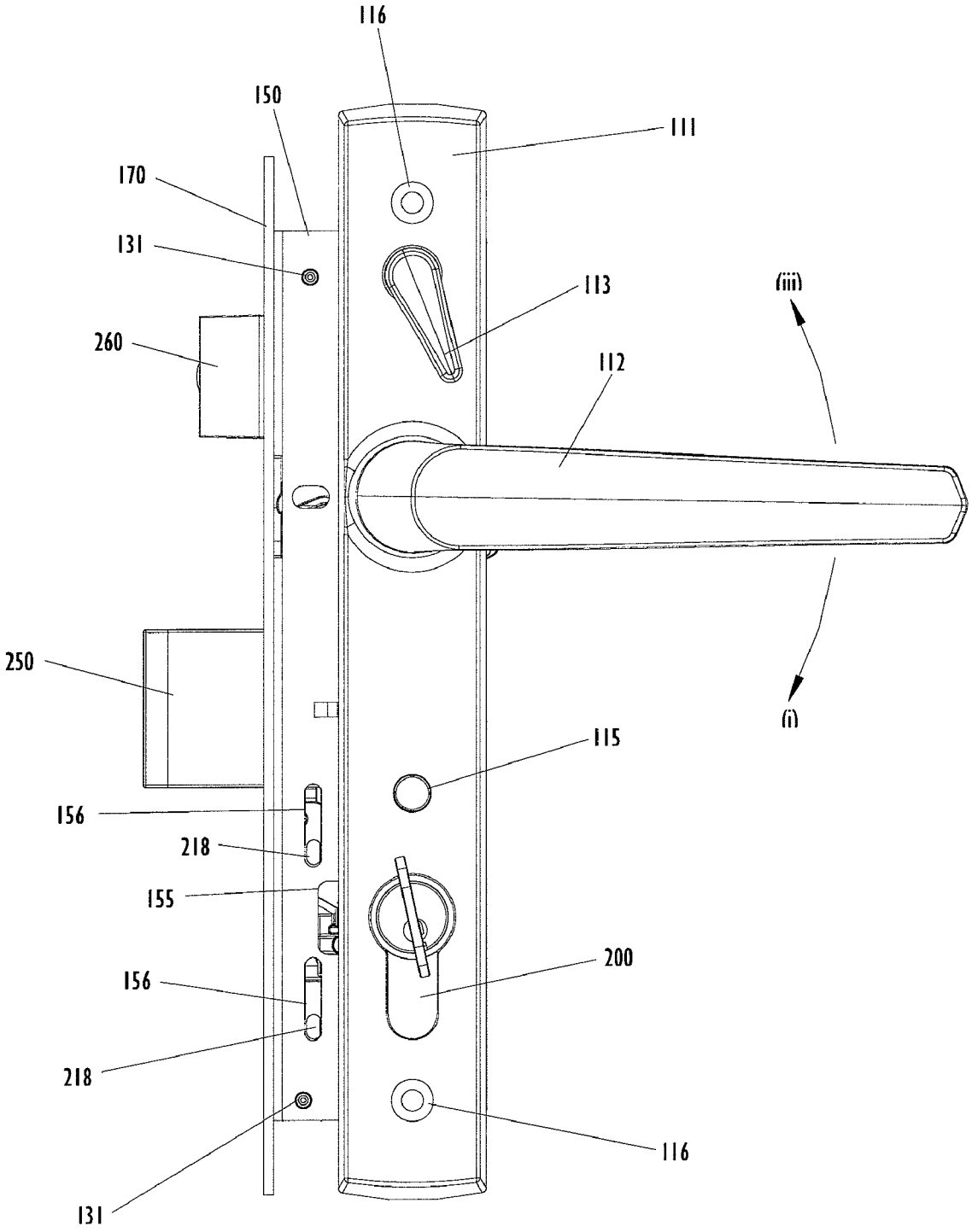
FIG. 4 is a side view of the lock in the "secure mode" ("deadlocked mode").

Before examining the operation and interaction of the lock's internal components in detail, it is useful to summarise the overall function of the lock from a user's point of view. This will be done primarily with reference to FIGS. 2-4. In FIGS. 2-4, the lock 100 and the door's inside furniture 110 are shown as if they were installed on a door, but the door itself is not shown. In other words, FIGS. 2-4 show the furniture 110 as it would be positioned relative to the lock 100 if the lock 100 and the furniture 110 were both installed on a door.

FIG. 2 shows the lock 100 and the furniture 110 in the passage mode. In this mode, the (inside) lever handle 112 can be rotated downwards as indicated by arrow (i) to retract the latch tongue 260 to allow the door to be opened. In the passage mode, the door's outside handle can also be rotated downwards similarly to retract the latch tongue 260. In this embodiment, less than 40° of rotation in the direction of arrow (i) will fully retract the latch tongue 260 to enable the door to be opened.

The inside of the escutcheon 111 contains a "shuttle" mechanism which functions to return the handle to the horizontal position when the user lets go of the handle. This "shuttle" mechanism is visible in FIG. 33, but it is also described in detail in our Australian Patent Application No 2007201170. The "shuttle" mechanism therefore requires no further explanation here. Referring again to the present lock mechanism, the lock incorporates a spring 269 (described further below) which functions such that, when the user lets go of the handle, the latch tongue 260 also extends back out of the lock.

FIG. 3 shows the lock 100 and furniture 110 in the safety mode. The lock is converted from the passage mode shown in FIG. 2 to the safety mode shown in FIG. 3 by rotating the snib lever 113 (which is on the inside face of the door) in the direction shown by arrow (ii). In the safety mode, the door's handles are unable to rotate downwards past the horizontal in the direction of arrow (i) (see FIG. 2), so they cannot be used to retract the latch tongue 260 to open that door.

If the lock is in the safety mode and it is desired to open the door from the outside, it is necessary to insert a key into the key cylinder on the outside and turn it to "un-snib" the lock from the outside. In order to "un-snib" the lock from the outside using the key, it is not necessary to turn the key as far as would be required to deadlock the lock. Rotating the key from the outside sufficiently far to un-snib the lock returns the lock to the passage mode in which both handles can be used to retract the latch tongue 260.

A key can also be used in the same manner to "un-snib" the lock from the inside. In other words, it is possible to insert a key into the key cylinder from the inside and turn it sufficiently far to un-snib the lock. This returns the lock to the passage mode in the same way as using the key from the outside. However, there is an additional way to "un-snib" (i.e. convert the lock from the safety mode to the passage mode) from the inside. This is done by moving the snib lever 113 in the opposite direction to arrow (ii) (see FIG. 3). This also has the effect of freeing the internal handle 112 (and also the external handle) to allow the handles to be used to open the door.

As mentioned briefly above, the embodiment of the invention shown in FIGS. 1-33 is designed to operate as the central lock in a multipoint lock assembly. More specifically, the lock shown in these figures will typically be used in a four-point lock assembly. The four "points" are the components which engage with the doorframe, namely the latch tongue 260, the deadbolt 250, the upper remote bolt (not shown) and the lower remote bolt (not shown). The upper remote bolt and the lower remote bolt are operated by an upper connecting/operating rod (not shown) and a lower operating/connecting rod (not shown) respectively. The upper connecting rod connects to the upper shoot bolt 310 and the lower connecting rod connects to the lower shoot bolt 330. Hence, the remote bolts are operated by extending and retracting the shoot bolts. More specifically, when the upper shoot bolt 310 moves upwards in the lock and the lower shoot bolt 330 moves downwards in the lock, these movements are transmitted via the respective connecting rods to throw (i.e. extend) the respective upper and lower remote bolts. Conversely, when the upper shoot bolt 310 moves downwards in the lock and the lower shoot bolt 330 moves upwards in the lock, these movements are transmitted via the respective connecting rods to retract the respective upper and lower remote bolts. Those skilled in the art should be familiar with the kinds of remote bolts that are used in association with central locks in multipoint lock assemblies, and any such form of remote bolt capable of being operated by the shoot bolts 310, 330 may be used.

It is possible to extend the shoot bolts to operate the remote bolts (as just described) by rotating the internal handle 112 upwards in the direction of arrow (iii) (see FIG. 3). Rotating the handle 112 upwards in the direction of arrow (iii) causes the upper shoot bolt 310 to move upwards and the lower shoot bolt 330 to move downwards, thus operating the remote bolts as described above. The shoot bolts (and hence the remote bolts) then remain in the extended/thrown position even when the "shuttle" mechanism in the escutcheon causes the handle 112 to return to the horizontal position shown.

If the shoot bolts are extended while the lock 100 is in the passage mode, it is possible to then retract the shoot bolts (and hence retract the remote bolts) by rotating the handle 112 downwards from the horizontal position in the direction of arrow (i). In other words, if the shoot bolts (and hence the remote bolts) are extended while the lock 100 is in the passage mode, the shoot bolts (and hence the remote bolts) can be retracted by operating the handle 112 in the same way as it would be used to withdraw the latch tongue 260 to open the door. In fact, the latch tongue 260 is retracted into the lock as normal when the handle 112 is rotated downwards to retract the shoot bolts.

However, as described above, when the lock is in the safety mode, the lock's snib mechanism prevents the handle 112 from rotating downwards past the horizontal in the direction of arrow (i) (see FIG. 2). Therefore, it is not possible to rotate the handle to retract the shoot bolts while the lock is in the safety mode. If the lock is in the safety mode and it is desired to retract the shoot bolts, it is necessary to first convert the lock from the safety mode to the passage mode. This can be done by either using the snib lever from the inside or by using a key from either side (as described above). Converting the lock into the passage mode frees the handle 112 to rotate downwards past the horizontal in the direction of arrow (i) (see FIG. 2) as required to retract the shoot bolts.

FIG. 4 shows the lock in the secure (or deadlocked) mode. To place the lock in the secure mode, a key must be inserted into the key cylinder (from either the inside or outside) and turned to throw (i.e. extend) the deadbolt 250. If the door is closed when the deadbolt is thrown, the deadbolt will insert into an opening in the door frame (or into a strike mounted in the door frame) to prevent the door from being opened. In order to "un-deadlock" the lock and convert the lock back into the passage mode, a key must be inserted into the key cylinder 200 and turned (this can be done either from the inside or the outside). It should be noted that the key must be turned further in order to "un-deadlock" the lock than is required to simply "un-snib" the lock in the manner described above.

In the secure mode, the lock's internal mechanism prevents the handles from being rotated downwards past the horizontal in the direction of arrow (i), just like when the lock is in the safety mode. However, when the lock is in the secure mode, the snib lever 113 cannot be used to convert the lock back into the passage mode. The only way to convert the lock back from the secure mode to the passage mode is by inserting and turning a key (this can be done from either side of the door). Put another way, the only way to "un-deadlock" the lock is by using the key.

If the lock is in the secure mode but the shoot bolts have not been extended to throw the remote bolts, then it is possible to rotate the handle 112 upwards in the direction of arrow (iii) (see FIG. 4) to extend the shoot bolts and throw the remote bolts. After this, the handle 112 can return to the horizontal position and the shoot bolts (and remote bolts) remain extended. However, as noted above, when the lock is in the secure mode, the mechanism prevents the handles from being rotated downwards past the horizontal in the direction of arrow (i). Therefore, it is not possible to use the handle 112 to withdraw the shoot bolts and retract the remote bolts while the lock remains in the secure mode. If the lock is in the secure mode and it is desired to withdraw the shoot bolts, a key must first be inserted and turned to withdraw the deadbolt 250. The lock is thereby converted back into the passage mode making it possible to use the handle 112 to retract the shoot bolts etc.

The lock mechanism includes a lock status indicator. The status indicator includes coloured components which move when the lock is converted between the modes. As a result, when the lock is in the passage mode and the safety mode, a portion of the status indicator which is coloured green is visible through the lens 115 in the lock's inside furniture. Conversely, when the lock is in the secure mode, a red portion of the status indicator is visible through the lens 115. As a result, when the lock is in the passage mode or the safety mode, the lens 115 looks green from the point of view of the user. On the other hand, when the lock is in the secure mode, the lens 115 looks red. Thus, the lock status indicator allows the user, when on the inside of the door, to readily determine whether or not the lock is in the secure mode (i.e. whether or not the lock is deadlocked). If the user sees from inside the door that the indicator is red, they know that the lock is deadlocked and a key is needed in order to "un-deadlock" it before it can be opened.

Having provided an overview of the lock's functionality from the user's point of view, it is possible now to examine the internal components of the lock and the way they interact to provide this functionality.

The main casing or enclosure inside which the lock's internal components are contained is formed by the body 130 and the cover plate 150. These are both best illustrated in the exploded view in FIG. 1. The body 130 is a die-cast zinc component, and the cover plate 150 is made from folded steel sheet. As noted above, the body 130 and the cover plate 150 do more than simply provide the casing for containing the lock's internal components. The body 130 and cover plate 150 are both also structural components, and they are both functional in that they interact with the lock's internal components in the operation of the lock.

Most of the functional interactions between lock's internal components and the body 130 and cover plate 150 will be further described below. However, at this point it may be noted that the body 130 has a number of fixing lugs 131 which engage with corresponding fixing holes 151 in the cover plate 150 to enable the cover plate 150 to be positioned and secured to the body 130 when the lock is assembled. Also, the body 130 has upstanding wall members 132 and 133 which act as guides for the latch tongue 260 and the deadbolt 250 respectively. The body 130 and the cover plate 150 both also have a number of cut-outs which accommodate or help to mount other components. For instance, the cover plate 150 has a snib spindle hole 153 which allows the square spindle 425 to extend from the snib lever 113 to engage with the lock's snib mechanism (described further below). The cover plate 150 also has a handle spindle hole 152 which allows a larger square spindle (not shown) to extend from the handle 112 through to connect with the hub mechanism 280 (also described further below). Furthermore, there is also a cut-out 154 in the cover plate, and a cut-out 134 in the body, both of which accommodate the key cylinder 200. The other cut-outs and features in the body 130 and the cover plate 150, and the way they interact with the lock's other components, will be described further below.

The key cylinder 200 used in the lock is shown separately in FIG. 1. The way that the key cylinder is positioned relative to the other components of the lock when the lock is assembled can be seen from FIGS. 5-7, 10 and 24. The key cylinder 200 has a cylinder cam 201 which moves in an arcuate path around the key cylinder 200 when a key is turned in the cylinder. The cylinder cam 201 engages with and operates other components of the lock when the key is turned. In particular, the cylinder cam 201 engages with the Talon assembly 210.

The Talon assembly 210 is visible in FIG. 1, but is shown more clearly in FIGS. 11 and 12. FIG. 11 is an exploded view of the Talon assembly and FIG. 12 shows the Talon assembly from side on when all of the parts have been assembled together. From FIG. 11 it can be seen that the Talon assembly 210 includes a Talon chassis 211, a Talon bolt 212 and a Talon spring 213. When these three components are assembled together, the cylindrical lugs 214 on either side of the Talon bolt 212 project sideways through the spaces 215 on either side of the box-like portion of the Talon chassis 211. In fact, the lugs 214 extend all the way through the respective spaces 215 such that the lugs 214 project proud from the Talon assembly on either side.

The Talon spring 213 is mounted in the space 216 between the flat back surface of the Talon bolt and the vertical rear wall of the box-like portion of the Talon chassis 211. The space 216 where the spring 213 resides is shown in FIG. 12.

When the Talon assembly 210 is assembled, the Talon bolt 212 is biased by the spring 213 in the direction of arrow (iv) (see FIG. 12), and one of the rounded lugs 214 normally abuts with the rounded end 220 of one of the spaces 215. However, the cylinder cam 201 can push the bolt 212 back in the opposite direction to arrow (iv) (against the bias of the spring 213) when the key is turned. To enable this, the surfaces 219 of the box-like portion (shown in FIG. 11) are angled so as to permit the cylinder cam 201 to enter the box-like portion and push the bolt 212 back as the cam 201 is rotated by the user turning the key. The cylinder cam 201 can also push on the respective surfaces 219 in order to move the Talon assembly. This will be explained further below.

The Talon chassis 211 also includes a lug 217 which engages with the locking link 230 as described further below.

Referring again to FIG. 1, it will be seen that the body 130 includes a "["-shaped cut-out 135. There is also a corresponding "["-shaped cut-out 155 in the cover plate 150. When the lock 100 is assembled, one of the lugs 214 of the Talon bolt (remember: the lugs extend proud from the Talon assembly) inserts into the cut-out 135 in the body, and the other lug 214 (i.e. the protruding lug on the other side of the Talon assembly) inserts into the cut-out 155 in the cover plate. In each of the "["-shaped cut-outs, the upper horizontal portion of the "[" creates an upper point of entrapment, and the lower horizontal portion of the "[" creates a lower point of entrapment. This will be described further below.

FIG. 1 also shows that the Talon chassis 211 includes two small guide lugs 218 located on the opposite side of the chassis 211 from the Talon bolt 212. The guide lugs 218 insert into guide channels 156 in the cover plate 150.

Figure 5:
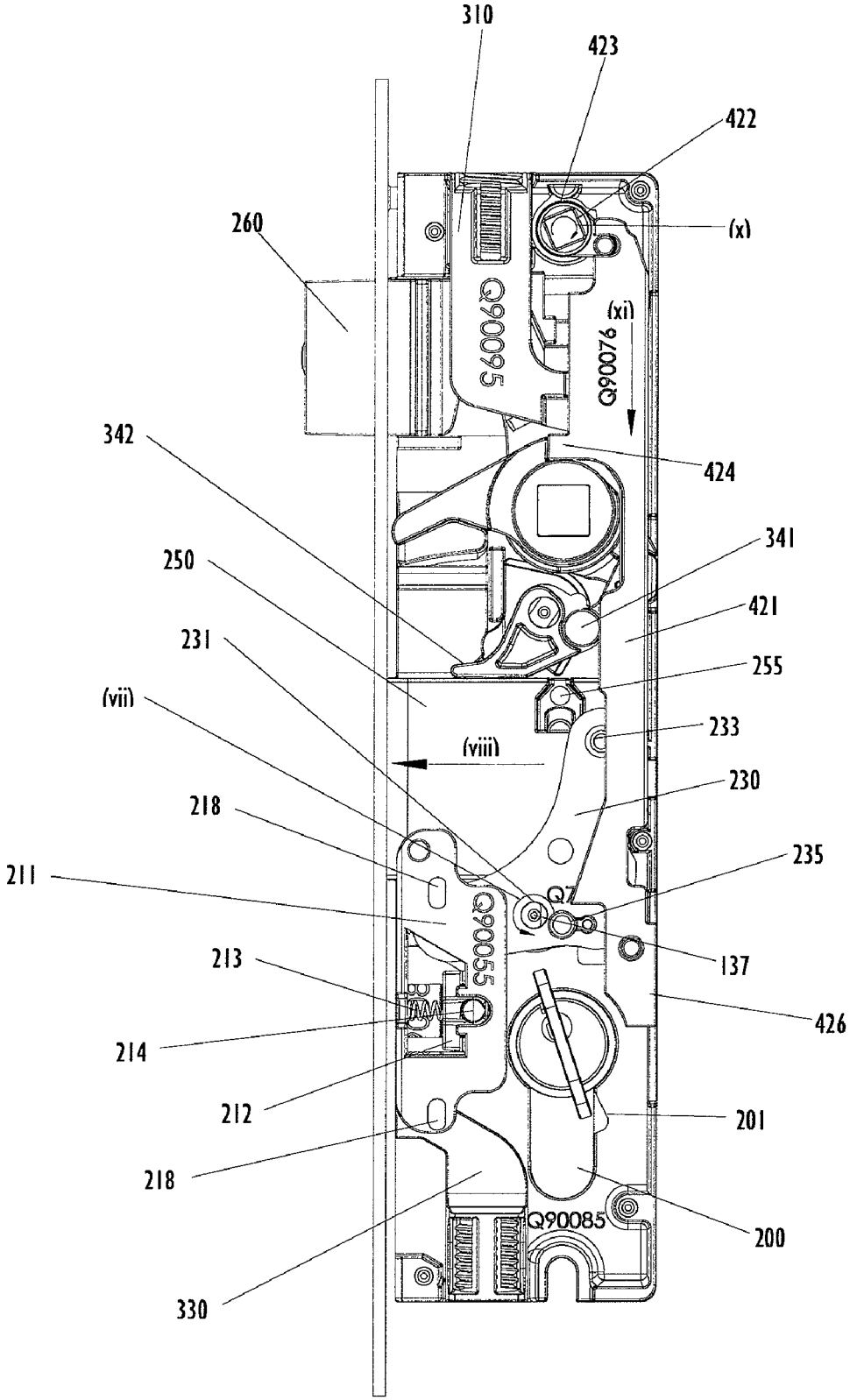
FIG. 5 is a side view of the lock with the lock furniture and cover plate removed to reveal the internal workings of the lock when the lock is in the safety mode.

The operation of the Talon assembly 210 can be most easily understood with reference initially to FIG. 5 (and also FIG. 1). FIG. 5 shows the lock 100 fully assembled, except that the cover plate 150 has been omitted (as has the furniture 110) to reveal the lock's internal components. The lock is shown in the safety mode. In this configuration, the respective lugs 214 on either side of the Talon bolt reside in the upper points of entrapment described above. That is, one of the lugs 214 resides in the upper horizontal portion of the "["-shaped cut-out 155, the other lug 214 resides in the upper horizontal portion of the "["-shaped cut-out 135, and the Talon spring 213 pushes the Talon bolt 212 forward so that the lugs 214 push against the closed rounded ends of the respective upper horizontal portions. When the lugs 214 are in this position, the Talon assembly 210 is prevented from moving vertically downwards in the lock. This is because the lugs 214 engage against the metal located between the two horizontal portions of each "[", thus constraining any such motion. Constraining the Talon assembly 210 from moving vertically prevents the deadbolt 250 from being thrown.

In order to extend (i.e. throw) the deadbolt 250 to deadlock the lock (i.e. to convert the lock to the secure mode), the key can be turned in the direction of arrow (v) as shown in FIG. 5. Turning the key in this direction causes the cylinder cam 201 to move in an arc about the cylinder 200, in the same direction as arrow (v). The cam will actually move from the position shown in FIG. 5, all the way up and over the top of the key cylinder 200, before coming into contact with the Talon assembly 210. It also disengages the snib mechanism as it moves in this way, but this will be described below.

Referring again to the operation of the Talon assembly 210, when the cam 201 comes into contact with the Talon assembly, it initially enters the box-like portion of the Talon chassis 211 (visible in FIG. 11). With continued rotation, the cylinder cam 201 comes into contact with the Talon bolt 212 and pushes the bolt back against the bias of Talon spring 213. This in turn causes the lugs 214 on the Talon bolt to slide out of the upper points of entrapment and into the vertical "|" portions of the respective "["-shaped cut-outs. When the lugs 214 move into the vertical "|" portions of the "["-shaped cut-outs, the Talon chassis 211 is then free to move vertically in the lock with each lug 214 moving vertically in its respective "|" portion.

With further rotation of the key in the direction of arrow (v) (see FIG. 5), the cylinder cam 201 then pushes against the lower of the two angled surfaces 219 of the Talon chassis's box-like portion. This slides the Talon chassis 211 downwardly in the lock. As the Talon chassis 211 slides downwardly, the lugs 214 on either side of the Talon bolt 212 move downwardly in the vertical "|" portions of the respective "["-shaped cut-outs. Also, the guide lugs 218 slide within the respective guide slots 156 in the cover plate 150 and ensure that the Talon assembly 210 does not pivot or "cant over" as it moves downwardly in the lock.

Ultimately, turning the key as described in the previous three paragraphs will cause the lugs 214 on either side of the Talon bolt to reach the bottom of the vertical "|" portion of the respective "["-shaped cut-outs. Further rotation will then see the cylinder cam 201 disengage from the Talon bolt 212 and then rotate out of the box-like portion of the Talon chassis. When this happens, the Talon spring 213 again pushes the Talon bolt 212 forward, thus pushing the respective lugs 214 into the lower points of entrapment in the respective "["-shaped cut-outs. The positioning of the lugs 214 in the lower points of entrapment constrains the Talon assembly 210 from moving vertically upwards in the lock, again, because the lugs 214 engage against the metal located between the two horizontal portions of each "[". Of course, the key can be rotated in the opposite direction to arrow (v) in order to return the Talon assembly 210 from the lower position (in which the lock is deadlocked) back to the upper position. Doing so reverses the motion of the various components just described.

At this point, it should be recalled that the Talon chassis 211 incorporates a lug 217 which engages with the locking link 230. As can be seen from FIGS. 1, 17-19, the locking link 230 is a generally L-shaped component. It is pivotally mounted on the lock link mounting post 137 of the body 130. The rounded lug on top of the post 137 inserts into the round pivot point hole 231 in the locking link. The lug 217 on the Talon chassis 211 inserts into a Talon slot 232 in the locking link, thus connecting the Talon assembly 210 to the locking link 230. The locking link 230 also has a deadbolt plug 233 which connects with a recess 251 on the back of the deadbolt 250. Many embodiments of the lock will also have an additional recess 251*b* (see FIG. 25) for connecting a differently configured locking link 230 to the deadbolt 250 at a position lower down the deadbolt 250 than recess 251. The reason for doing this will be explained further below.

Figure 9:
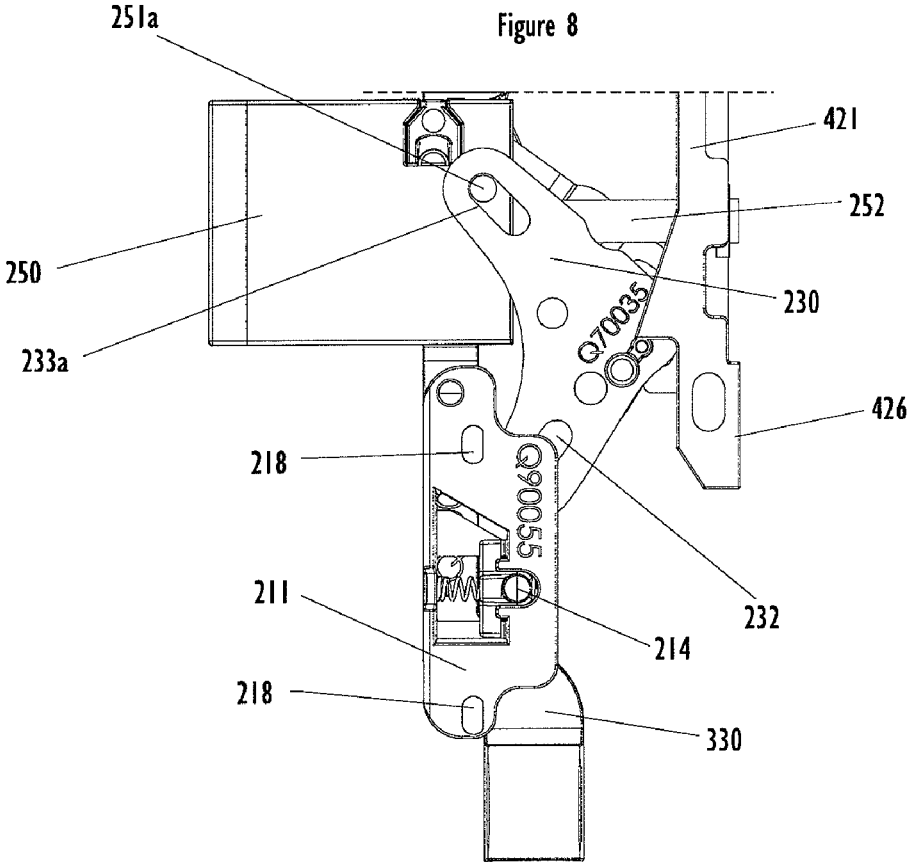
FIG. 9 is a partial view of the lower part of the lock when the lock is in the secure mode.

Note: FIG. 9 shows a slightly different configuration to that described in the previous paragraph. In FIG. 9, there is an extra slot 233*a* in the locking link instead of the plug 233. Also, the deadbolt 250 has a plug 251*a* instead of the recess 251. Thus, in FIG. 9, the plug 251*a* inserts into the recess 233*a* in order to connect the deadbolt 250 to the locking link 230. Despite this difference, the interaction between the locking link and the deadbolt in the configuration in FIG. 9 is otherwise similar.

Next, it is useful to refer again to the configuration of the lock shown in FIG. 5. In FIG. 5, the lock is in the safety mode and the Talon assembly 210 is in the upper position with the lugs 214 residing in the upper points of entrapment. When the key is turned in the key barrel 200 to move the Talon assembly 210 downwards as described above, this downward movement of the Talon assembly 210 also causes the lug 217 on the Talon chassis 211 to pull downwardly on the locking link's Talon slot 232. This in turn causes rotation of the locking link 230 about the axis of post 137 in the direction of arrow (vii) (see FIG. 5). When the locking link 230 rotates in this way, the deadbolt plug 233 pushes forwards on the recess 251 on the deadbolt in the direction of arrow (viii), thus driving the deadbolt 250 out of the lock. Hence, turning the key sufficiently far in the direction of arrow (v) causes the deadbolt to be extended (i.e. thrown) at the same time as the Talon assembly 210 moves down in the lock as described above. Conversely, turning the key sufficiently far in the opposite direction to arrow (v) causes the deadbolt to retract back into the lock simultaneously with the upward movement of the Talon assembly.

It should be noted that FIG. 5 shows the key in the "insertion orientation"—i.e. the orientation in which the key can be inserted into, and withdrawn from, the key cylinder 200. It is only possible to insert and withdraw the key in this orientation. If the key is in the cylinder and is rotated to any other orientation, the key cannot be withdrawn. In the illustrated embodiment, the serrated edge on the key blade (not shown) faces downwards. The serrations on the key blade operate to correctly position the split pins (not shown) inside the key cylinder, thereby allowing the barrel inside the cylinder to be turned by turning the key. This should be well understood by those skilled in this area.

It will be noted that the direction in which the key is turned to throw the deadbolt (i.e. the direction of arrow (v) in FIG. 5) is such that the edge of the key which points upwards when the key is in the insertion position moves towards the front edge of the lock (i.e. towards the forend plate) as the key is turned from the insertion position to throw the deadbolt. Locks in which the key is turned in this way to throw the deadbolt are said to be "keyed" towards the front of the lock. It is preferable for locks to be keyed in this way because this is often felt to be the most natural or intuitive direction to turn the key to deadlock the lock. Also, by keying locks this way users may come to automatically know (even if only subconsciously) which way to turn the key to deadlock or un-deadlock the lock.

It should be noted that again that the configuration and appearance of some components in FIG. 9 is slightly different to the way the same components appear in other Figures. Nevertheless, the overall operation and interaction between components remains similar. FIG. 9 shows the lock (or the lower part thereof) in the deadlocked mode after the deadbolt 250 has been thrown. As noted above, in this configuration the lugs 214 of the Talon assembly are engaged in the lower points of entrapment in the respective "["-shaped cut-outs, although this cannot be seen from FIG. 9 because the body 130 and cover plate 150 (and hence the "["-shaped cut-outs themselves) are not shown. Nevertheless, when the lugs 214 are engaged in the lower points of entrapment, this locks the deadbolt 250 against retraction because the lugs 214 engage against the metal located between the two horizontal portions of each "[". Hence, the only way to retract the deadbolt 250 is to use a key to rotate the cylinder cam 201 in the opposite direction to arrow (v) (see FIG. 5) which pushes the Talon bolt 212 back allowing the Talon assembly 210 to slide upwards.

Figure 25:
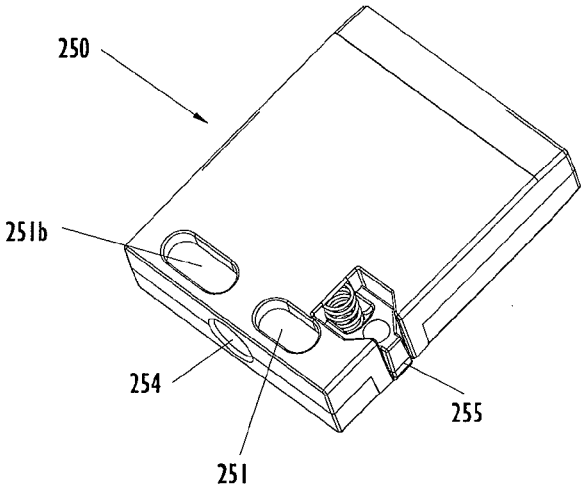
FIGS. 25 and 26 illustrate the sprung tongue member on the deadbolt which engages with the lower shoot bolt to prevent the shoot bolts from being retracted while the deadbolt is extended, as shown in FIG. 24.
Figure 26:
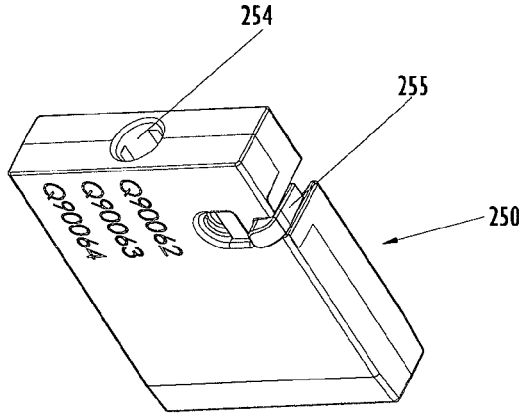
Figure 27:
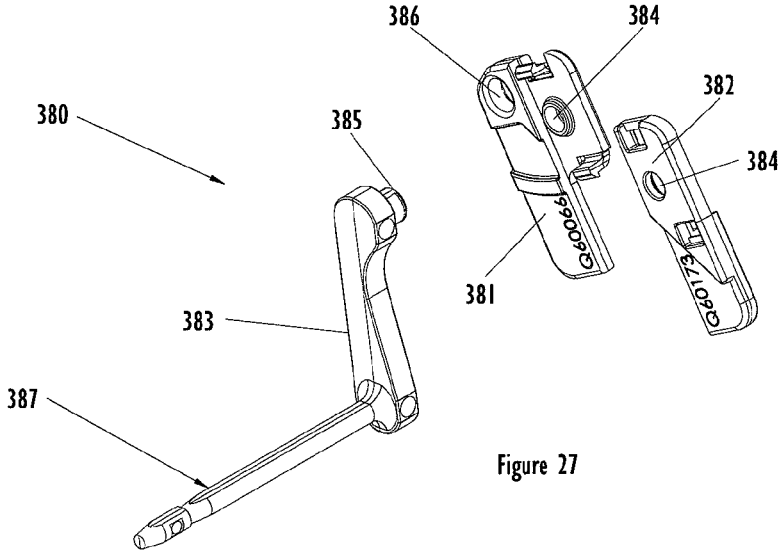
FIG. 27 is an exploded perspective view of the components of the lock status indicator mechanism.

The deadbolt itself is a zinc cast component and is shown separately in FIGS. 1, 25 and 26. The particular features of the deadbolt 250 shown in FIGS. 25 and 26 will be described in greater detail below. For now though it is useful to refer to FIG. 1. As explained above, the deadbolt 250 moves horizontally when it is extended and retracted. It is guided in this horizontal motion by certain features on the body 130 including the deadbolt guide wall 133. The deadbolt 250 is also supported on a deadbolt guide pin 252 which slots into a U-shaped slot 136 in the body 130. The deadbolt pin 252 is shown separately in FIG. 1, but is also shown more clearly in FIGS. 15 and 16. When the lock is assembled, the circular mounting portion 253 on the rear end of the pin 252 inserts into the U-shaped slot 136 in the body, and the elongate cylindrical portion of the pin 252 passes through the hole 254 in the core of the deadbolt 250.

It should be noted at this point that the combination of the following two design features, namely (a) this deadbolt pin configuration and (b) the ratio of the locking link rotation to deadbolt extension, allows the deadbolt 250 to extend a very long way out of the lock body when it is thrown. For instance, in one particularly common lock size, this configuration allows the deadbolt 250 to move a distance of 24 mm where the lock's "backset" (i.e. the thickness of the lock between forend plate and the rear edge of the lock body 130) is only 30 mm. The ability to provide large deadbolt extension in locks with relatively small backsets is advantageous because it means that the lock can provide an increased level of security whilst the lock itself remains thin (and therefore usable in doors where limited space is available for lock mounting).

Furthermore, this configuration also allows the lock to be quite adaptable, particularly if (as it does in the illustrated embodiment) the lock incorporates an additional means for connecting the locking link 230 to the deadbolt 250 at a position lower down the deadbolt 250 than recess 251. As was mentioned briefly above, in this embodiment, the additional means takes the form of the additional recess 251*b* in the deadbolt 250 (although a wide range of other means may also be used). If it is desired to change the distance that the deadbolt extends out when it is thrown (as may be necessary for door jams or strikes which cannot accommodate large deadbolt extension), this can be done simply by removing the existing locking link 230 and inserting a replacement locking link which has a lug which connects with the additional recess 251*b* instead of connecting to recess 251. Because the additional recess 251*b* is located further down the deadbolt 250 than protrusion 251, this changes the ratio of the locking link rotation to deadbolt extension, thereby changing the distance that the deadbolt 250 is thrown. However, importantly, there is no need to replace the deadbolt 250 itself or otherwise reconfigure it in any way. This is also highly beneficial because, in other locks, in order to adjust the distance that the deadbolt extends out when it is thrown (if this is possible at all), it is commonly necessary to use a separate deadbolt.

Referring again to FIG. 1, it can be seen that the lock 100 also incorporates a latch locking bar 240. The locking bar 240 comprises an elongate central portion 241, a rectangular portion 242 on the upper end of the central portion, and a connecting portion 243 on the other end. The connecting portion lies in the same plane as the rectangular portion 242 and it has a notch therein. The notch receives and is operated by a detent on the lock status indicator take off tube 235, as described below.

Figure 10:
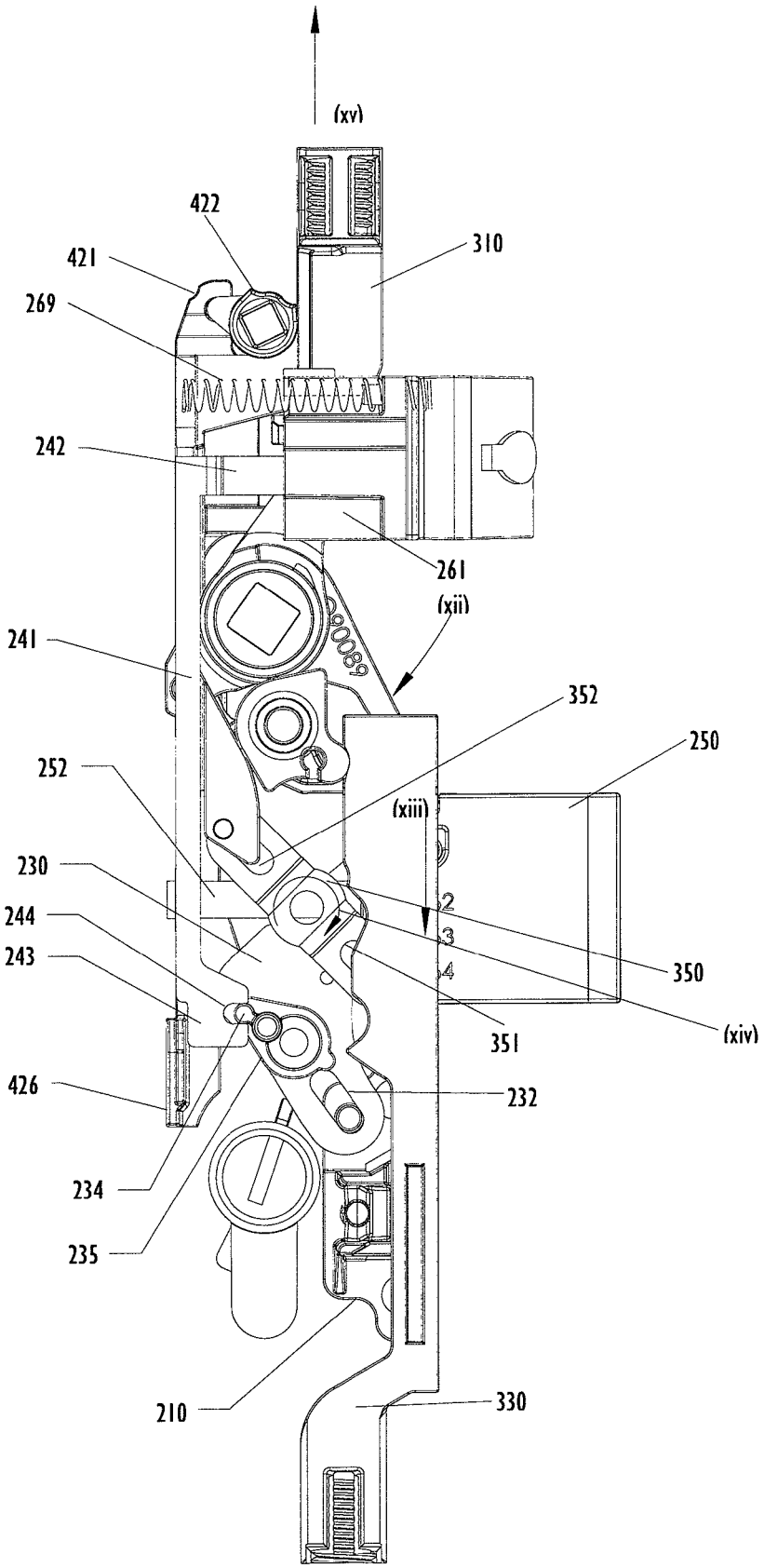
FIG. 10 is similar to FIG. 7 in that it shows the internal workings of the lock when the lock is in the secure mode and the shoot bolts are extended to operate the remote bolts, except that FIG. 10 shows the lock from the other side (compared with FIG. 7) and the lock body and certain other components have been omitted from FIG. 10 for clarity.
Figure 15:
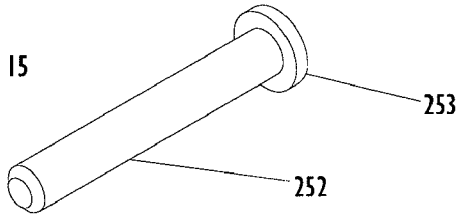
FIG. 15 illustrates the deadbolt guide pin in perspective view.
Figure 16:
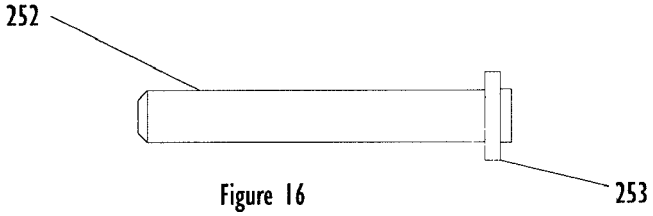
FIG. 16 is a side view of the deadbolt guide pin.
Figure 17:
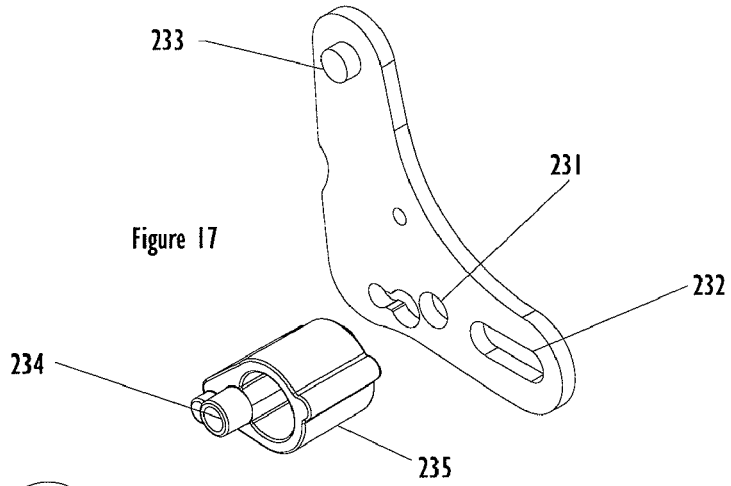
FIG. 17 shows the lock status indicator take-off component separately (i.e. exploded) from the locking link.
Figure 18:
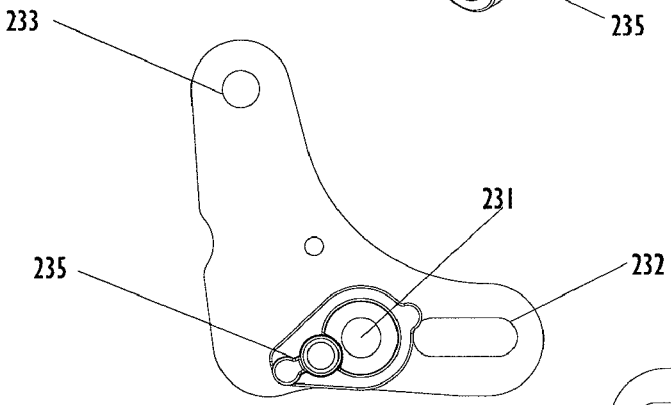
FIG. 18 shows the lock status indicator take-off component connected to the locking link.
Figure 19:
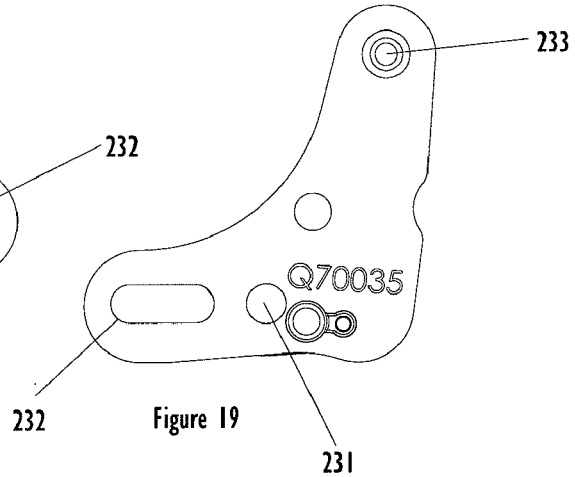
FIG. 19 also shows the lock status indicator take-off component connected to the locking link, but from the opposite side of the locking link compared with FIG. 18.

The way that the locking bar 240 is mounted in the assembled lock can be seen from FIG. 10. FIG. 10 shows the lock from the opposite side to FIG. 5-9. As can be seen, the locking bar 240 is mounted towards the back of the lock (i.e. near the back wall of the body 130). FIG. 10 also shows the way the connecting portion 243 of the locking bar connects with the locking link 230. The notch 244 in the connecting portion on the lower end of the locking bar receives a detent 234 which is part of the lock status indicator take off tube 235. The lock status indicator take off tube is connected to, and rotates with, the locking link 230. Hence, when the key is turned to move the Talon assembly thereby rotating the locking link and throwing the deadbolt as described above, this rotation of the locking link also causes similar rotation of the lock status indictor take off tube 235. This in turn causes the detent 234 to push upwards on the notch 244, thus pushing the locking bar 240 upwards in the lock.

Hence, when the key is turned sufficiently to fully throw the deadbolt 250, the locking bar 240 is moved into the position shown in FIG. 10. In this position, the rectangular upper portion 242 of the locking bar is located behind the rear edge of the latch bolt 260. Hence, any attempt to retract the latch bolt (whether using the handle 112 or in an unauthorised manner using a jemmy etc) will cause the rear of the latch bolt 260 to collide with the rectangular portion 242. Thus, the latch tongue 260 is locked against retraction when the lock is in the secure (deadlocked) mode shown in FIGS. 7, 9 and 10. This is how the lock prevents the handle 112 from being used to retract the latch tongue when the lock is deadlocked. If the user attempts to rotate the handle 112 in the direction of arrow (i) past the horizontal position shown in FIG. 2 while the lock is deadlocked, the rear of the latch tongue will immediately collide with the rectangular portion 242 of the locking bar. Therefore, any rotation of the handle in the direction of arrow (i) past the horizontal is thereby prevented.

However, if the key is turned on the opposite direction to arrow (v) (see FIG. 5) to convert the lock back into the passage mode, the locking bar 240 will slide back down in the lock. In fact, if the lock is converted fully back into the passage mode, the locking bar 240 will be positioned so that the rectangular portion 242 becomes aligned with the box-shaped indent 261 in the bottom rear corner of the latch tongue 260. The box-shaped indent 261 in the latch tongue can be seen in FIG. 10, and also in the exploded view of FIG. 1. When the locking bar 240 is in this lowered position, the latch tongue 260 is again able to be retracted because the box-shaped indent 261 slides over the rectangular portion 242 as the latch tongue 260 moves back into the lock. Hence, when the locking bar 240 is in this lowered position (and assuming the lock is not snibbed into the safety mode), it is possible to rotate the handle 112 in the direction of arrow (i) (see FIG. 2) past the horizontal in order to retract the latch tongue 260 because when this is done the latch tongue 260 moves so that the box-shaped indent engulfs the rectangular portion 242 (unlike in the deadlocked configuration where the rear of the latch bolt 260 collides with the rectangular portion 242).

Other features of the latch bolt 260 are shown in FIGS. 13 (exploded view) and 14 (assembled side on view). FIG. 13 shows that the latch bolt 260 is made from a number of parts. The two main parts are the bevelled tip 262 and the rear portion which will be referred to as the carriage 263. The bevelled tip 262 is a generally wedge shaped part with a slightly curved tapered surface that can ride over a door jam or strike pushing the latch bolt 260 inwards in the conventional way when the door is closed. The carriage 263 has a large drive recess 266 on one side and towards its rear. A small triangular lug 268 projects laterally from the top rear corner of the carriage adjacent the recess 266. The carriage 263 also incorporates the box-shaped indent 261 mentioned above, although the indent 261 is hidden from view on the other side of the carriage in FIGS. 13 and 14 (the indent can be seen in FIGS. 1 and 10).

The tip 262 and carriage 263 are held together by a fixing screw 264. The screw 264 inserts through a hole 267 in the tapered face of the tip 262. There is also an insert 265. The insert 265 acts as a cover for the hole 267, however it also functions as a sound deadening wear strip. In other words, the insert 265 is the first part of the tip 262 to bear and absorb the initial impact when the tip 262 collides with the door jam or strike as the door is closed and it therefore muffles the impact noise. It also serves to minimise wear between the tip 262 and the door jam or strike.

The latch bolt 260 may also include optional spacers or "packers" 270 clamped in between the tip 262 and the carriage 263. FIGS. 13 and 14 show one packer 270, although a greater number (or none) may be used. If present, the packer (s) 270 may be inserted in any desired number or combination to enable lateral adjustment in the overall length of the latch bolt 260.

As has been explained above, when the lock is in the passage mode, it is possible to retract the latch bolt 260 to enable the door to be opened using the handle 112. The handle 112 is linked with the latch bolt 260 via the hub assembly 280. The hub assembly 280 is shown in exploded view of FIG. 1, but it can be seen more clearly on its own in FIG. 20 (and in assembled side on new in FIG. 21).

The hub assembly 280 comprises three parts, namely the latch bolt drive member (or "drive member") 281, the first hub 282, and the second hub 283. The first hub 282 and the second hub 283 each have a square aperture extending through the centre. The inside of the handle 112 also has a similar square aperture 117 (see FIG. 33). A rigid square handle spindle (not shown) can therefore be inserted into the aperture 117 in the handle 112 and also through both the apertures 284 in the respective first and second hubs. In this way, the handle 112 becomes rigidly linked with each of the hubs 282 and 283 via the spindle. Hence, any rotation of the handle 112 causes corresponding rotation of rotation of the first hub 282 and second hub 283. Alternatively, if rotation of the hubs is prevented in one or both directions, corresponding rotation of the handle in that/those directions is also prevented.

It will be noted that the drive member 281 does not have a square aperture in the centre like the hubs 282 and 283. Consequently, the handle spindle is not rigidly engaged with the drive member 281, and the drive member is capable of a degree of movement independently of the hubs. The effect of this will be described further below.

Hub assembly 280 is shown in a side on view in FIG. 21, and the general way in which the hub assembly 280 is positioned in the lock is shown in FIGS. 5-10. The various different functions of the hub assembly 280 as shown in these different Figures require further explanation.

Figure 6:
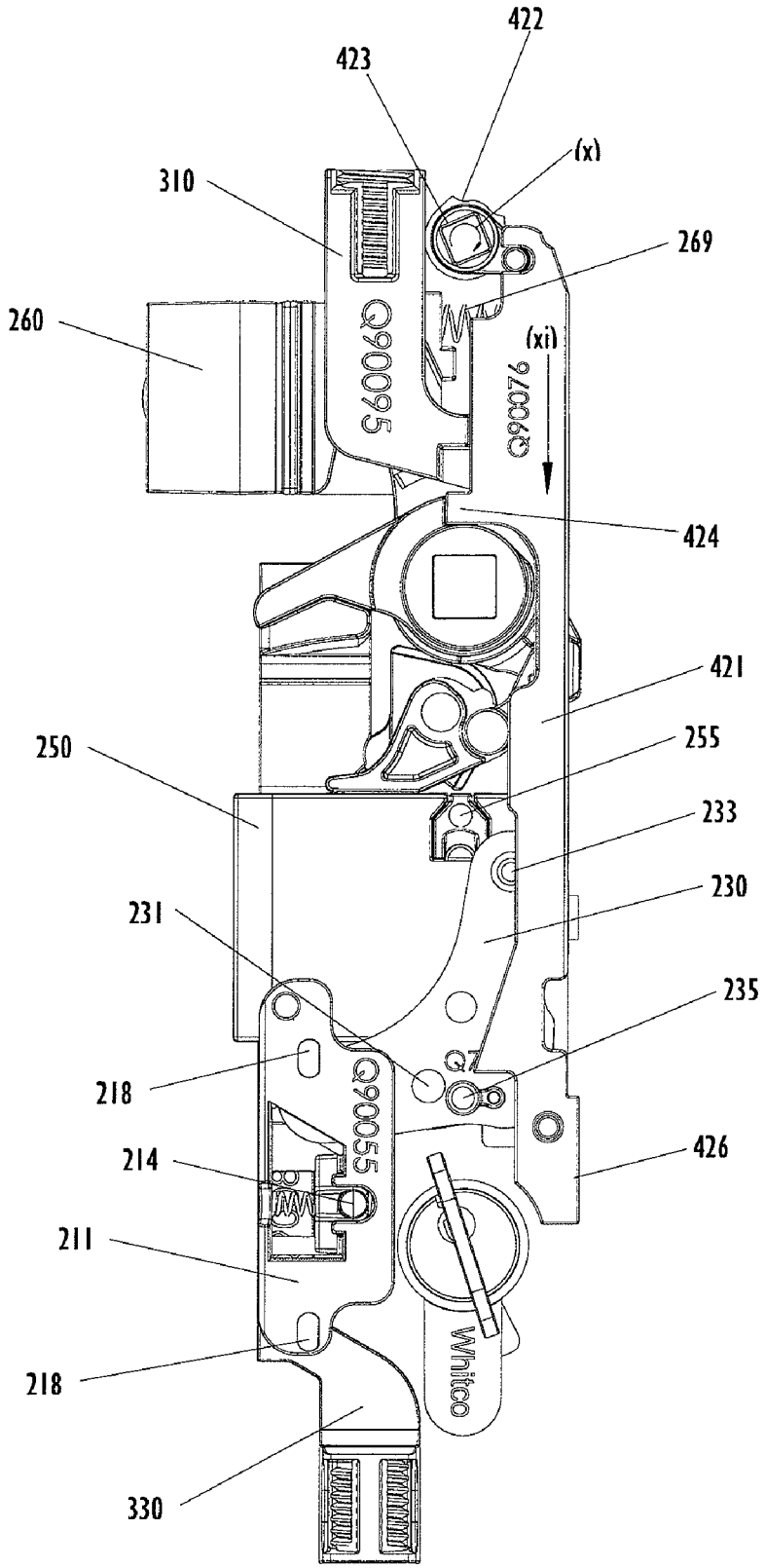
FIG. 6 is similar to FIG. 5 in that it shows the internal workings of the lock when the lock is in the safety mode, except that the lock body has been omitted in FIG. 6 for clarity.
Figure 7:
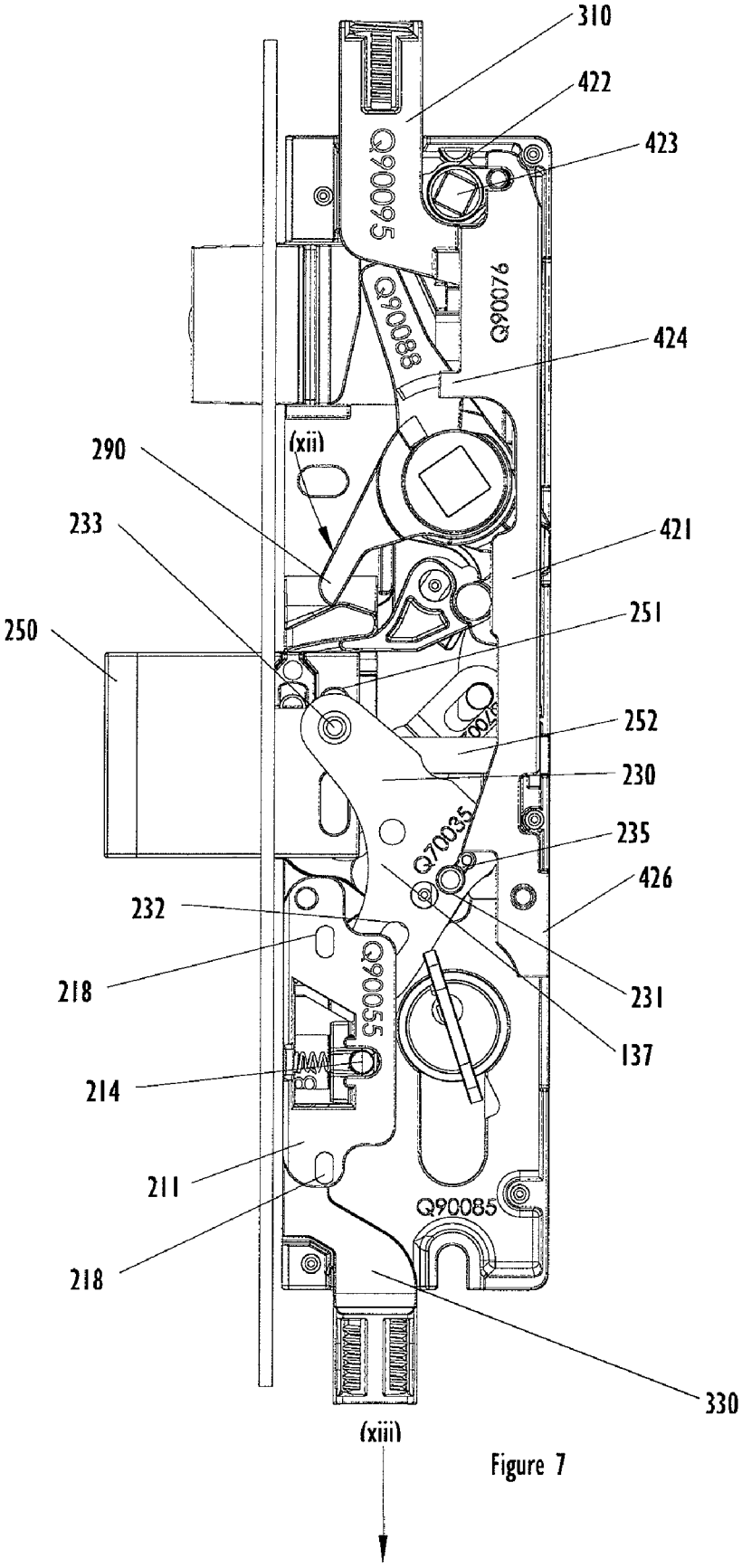
FIG. 7 is a side view of the lock with the furniture and cover plate removed to reveal the internal workings of the lock when the lock is in the secure (deadlocked) mode and the shoot bolts are extended to operate the remote bolts.

However, before referring to the operation of the hub assembly 280 in FIGS. 5-10, it is necessary to refer again to FIG. 20 from which it can be seen that the first hub 282 and the second hub 283 each have a drive protrusion (both of which are labelled 285). Each of the drive protrusions 285 is able to bear against a corresponding driven protrusion 286 on the drive member 281. FIG. 20 also shows that the drive member 281 has a main projecting latch bolt driving arm 287. FIG. 7 shows that when the hub assembly 280 is assembled in the lock, the driving arm 287 inserts into the drive recess 266 in the latch bolt carriage 263.

Figure 8:
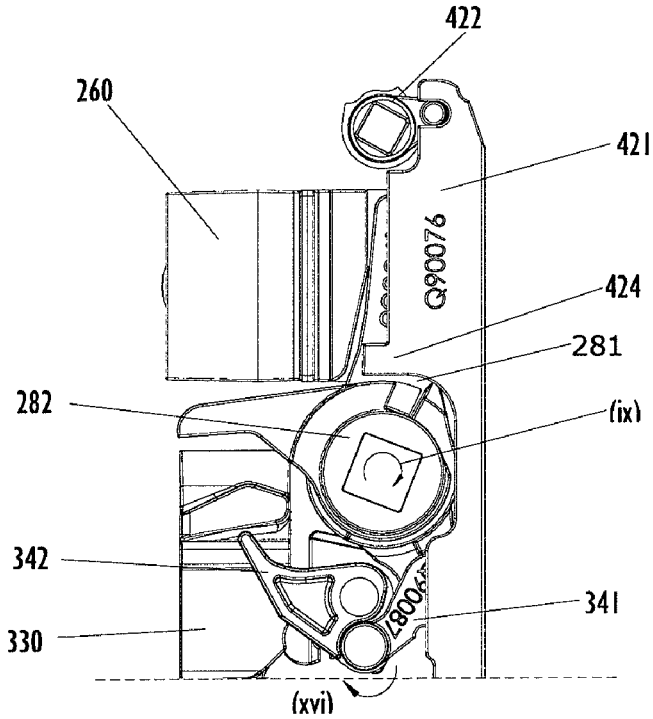
FIG. 8 is a partial view showing the workings of the upper part of the lock when the lock is in the passage mode and the latch bolt has been retracted.

FIG. 8 illustrates the way in which the hub assembly 280 operates to retract the latch bolt 260. As noted above, the handle 112 is rigidly linked the hubs 282 and 283 via a rigid square spindle (not shown). Therefore, when the handle 112 is rotated past the horizontal in the direction of arrow (i) (see FIG. 2), this causes identical rotation of the hubs 282 and 283. This identical rotation is indicated by arrow (ix) in FIG. 8. When the hubs 282 and 283 rotate in the direction of arrow (ix), this causes the driving protrusions 285 on the hubs to push against the driven protrusions 286 on the drive member. This in turn causes the drive member 281 to rotate in the direction of arrow (ix). When the drive member 281 rotates in this direction, it's drive arm 287 pushes back on the carriage's triangular lug 268 forcing the carriage (and hence the entire latch bolt 260) backwards in the lock as shown in FIG. 8. This is how the handle 112 operates the hub assembly 280 to retract the latch bolt 260.

As mentioned previously, the lock has a spring 269 which operates to push the latch bolt 260 back out when the user lets go of the handle. Also, when the user lets go of the handle, the shuttle mechanism shown in FIG. 33 causes the handle to return to the horizontal position. The spring is labelled 269 and can be seen most clearly in FIGS. 13 and 14, although it can also be partially made out in FIGS. 1, 5-6 and 10. The spring 269 is a resilient helical spring. When the lock is assembled, the spring 269 is mounted in compression between the latch bolt carriage 263 and the rear wall of the body 130. This compressive mounting of the spring is what biases the latch bolt 260 towards its extended latching position. The spring actually slides onto a small rod-like portion 271 on the rear of the carriage 263, and this prevents the spring from moving, buckling or "springing away" from the carriage when it is mounted in compression in the assembled lock.

The hub assembly 280 also performs certain other functions in the lock, in addition to those described above, but it will be more convenient to refer to those functions after the operation of the lock's snib mechanism has been described. The components of the lock's snib mechanism are visible in FIG. 1. The assembled snib mechanism is also clearly visible in FIGS. 5-7 and 10. The snib mechanism comprises a snib bar 421 and a snib actuator 422. The snib actuator 422 is shown separately from the rest of the mechanism in FIG. 22 (perspective view) and 23 (side on view).

From FIGS. 22 and 23 it can be seen that the snib actuator 422 has a square aperture 423 in it. The aperture 423 is similar to (but smaller than) the square apertures 284 in the hubs 282 and 283. The aperture 423 also performs a similar purpose. That is, the rigid square snib spindle 425 is connected to the snib lever 113 and inserted through the aperture 423 to thereby rigidly link the rotation of the snib handle 113 with the rotation of the snib actuator 422.

FIG. 5 illustrates the way in which the snib mechanism 420 is linked with the hub assembly 280 to enable snibbing and unsnibbing of the lock. "Snibbing" the lock converts lock from the passage mode to the safety mode, and "un-snibbing" the lock converts the lock from the safety mode to the passage mode. As noted above, the snib lever 113 is rigidly linked to the snib actuator assembly 422 via the square spindle 425. Therefore, when the snib lever 113 is rotated in the direction of arrow (ii) (see FIG. 3) to snib the lock, this causes identical rotation of the snib actuator 422. This identical rotation is indicated by arrow (x) in FIGS. 5 and 6.

From FIGS. 5 and 6, it can be seen that the snib bar 421 has detent 424 which projects towards the front of the lock. FIG. 20 shows that the first hub 282 has a stopping face 289 which is slightly recessed relative to the driving protrusion 285. When the snib actuator 422 is rotated in the direction of arrow (x) as shown in FIGS. 5 and 6 (i.e. when the lock is snibbed), this in turn drives the snib bar 421 downwardly in the lock in the direction of arrow (xi) such that the detent 424 on the snib bar moves into the space in front of the first hub's stopping face 289 (i.e. the detent moves into the space beside the first hub's driving protrusions 285). This is shown in FIGS. 5-6. When the snib detent 424 is in this position, any attempt to rotate handle 112 downwardly past the horizontal in the direction of arrow (i) (see FIG. 2) to try and retract the latch bolt 260 is prevented because the first hub's stopping face 289 collides with the detent 424. It will be appreciated that operation of the lock's external handle is also prevented when the lock is snibbed because the external handle is rigidly linked to the internal handle via the rigid handle spindle (not shown). Hence, an attempt to rotate the outside handle downwards while the lock is snibbed would also cause the first hub's stopping face 289 to collide with the detent 424. This is how the lock prevents the handles from being used to retract the latch tongue when the lock is in the safety mode (i.e. when the lock is snibbed).

As described above, if it is desired to "un-snib" the lock (i.e. convert the lock from the safety mode to the passage mode) from the inside, this can be done by rotating the snib lever 113 in the opposite direction to arrow (ii) (see FIG. 3). This in turn causes the snib actuator 422 to rotate in the opposite direction to arrow (x) which pulls the snib bar 421 back upwardly in the lock. FIG. 7 shows the snib mechanism in the "un-snibbed" configuration (i.e. when the snib bar 421 has been pulled back upwardly in the lock). In this position, the snib detent 424 is raised up out of the space in front of the first hub's stopping face 289. Therefore, the detent 424 no longer impedes the rotation of the first hub 282. Hence, if the lock was not deadlocked as shown in FIG. 7, the handle 112 could be rotated in the direction of arrow (i) to thereby rotate the first hub 282 in the direction of arrow (ix) to retract the latch bolt 260 as shown in FIG. 8.

It will be recalled that from above that it is also possible to convert the lock from the safety mode to the passage mode using the key. To enable this, the snib bar 421 has a protruding rectangular portion 426 on its lower end (the rectangular portion 426 is shown most clearly in FIG. 1). It is easiest to understand the way that the key can be used to convert the lock from the safety mode to the passage mode by referring to Figures and 5 and 7. As explained above, when the key is turned in the direction of arrow (v) (see FIG. 5), this causes the cylinder cam 201 to move from the position shown in FIG. 5 in an arc about the cylinder 200 in the same direction as arrow (v). When the snib bar 421 is in the lower "snibbing" position as shown in FIG. 5, this movement of the cam 201 causes the cam to collide with and push up on the rectangular portion 426. This pushes the snib bar back up in the lock into its "un-snibbed" position shown in FIG. 7. It will be appreciated that when the key is turned to move the cam 201 in this way from the position shown in FIG. 5, the cam 201 will collide with and push the snib bar 421 up into the "un-snibbing" position well before it engages with the Talon assembly 210 to throw the deadbolt. Put another way, the cam 201 must continue to rotate a considerable distance after it has un-snibbed the snib mechanism before it engages the Talon assembly. This is why they key does not need to be turned as far to un-snib the lock as to throw the deadbolt.

At this point it is useful to explain how the shoot bolts can be extended and retracted to operate the remote bolts. From FIG. 20 it can be seen that the first hub 282 has a wing 290. When the handle 112 is rotated in the direction of arrow (iii) (see FIG. 3), this causes identical rotation of the hubs 282 and 283. The identical rotation of the hubs is indicated by arrow (xii) in FIGS. 7 and 10. When the hubs rotate in the direction of arrow (xii), the wing 290 on the first hub pushes downwardly on the upper end of the lower shoot bolt 330. This causes the lower shoot bolt 330 to move downwardly in the direction of arrow (xiii).

It has been noted previously that the movement of the lower shoot bolt 330 is linked to that of the upper shoot bolt 310 by a shoot bolt rocker 350. The shoot bolt rocker 350 is shown in FIG. 1. It can also be clearly seen in FIG. 10. The rocker 350 has a pair of slots 351 and 352 which engage with lugs 331 and 311 on the lower and upper shoot bolts 330 and 310 respectively. Hence, when the lower shoot bolt 330 moves down in the direction of arrow (xiii), this causes the rocker 350 to pivot as shown by arrow (xiv) in FIG. 10, which in turn pushes the upper shoot bolt 310 upwardly in the direction of arrow (xv). This is how the lock can be operated to extend the shoot bolts and thereby throw the remote bolts.

Retracting the shoot bolts in order to withdraw the remote bolts is achieved through the interaction of the hub assembly 280 with the shoot bolt return assembly 340. The shoot bolt return assembly 340 is shown in FIG. 1 and is also visible in FIGS. 5-8 and 10. The shoot bolt return assembly 340 is made up of two components, namely a pivot member 341 and a hook member 342. The pivot member 341 has two lugs. The first smaller lug 343 inserts into the hole 292 on the tab 291 of the hub assembly's drive member 281 (see FIG. 20). The pivot member's second larger lug 344 inserts into the recess 345 in the hook member 342. Hence, the hub assembly's drive member 281 is connected to the pivot member 341, which is in turn connected to the hook member 342, such that rotation of the drive member 281 actuates the hook member 342.

The way that the shoot bolts are retracted is illustrated in FIG. 8. It should be noted though that FIG. 8 shows a slightly different configuration of the shoot bolt return assembly to that shown in the other Figures. Nevertheless, the overall functionality of the shoot bolt return assembly 340 is the same. As explained above, when the handle 112 is rotated downwards past the horizontal in the direction of arrow (i) (see FIG. 2), this causes identical rotation of the hubs 282 and 283. This in turn causes the driving protrusions 285 on the hubs to push against the driven protrusions 286 on the drive member which then causes the drive member 281 to rotate in the direction of arrow (ix) (see FIG. 8). This rotation of the drive member causes the drive arm 287 to retract the latch bolt 260 (as explained above). However, in addition to this, the rotation of the drive member 281 also causes the tab 291 (which is on the drive member—see FIGS. 20-21) to rotate in the direction of arrow (ix). This in turn causes the pivot member 341 and the hook member 342 to move around as generally indicated by arrow (xvi) in FIG. 8, which in turn causes the pointed nose of hook member 342 to push up from underneath on the upper end of the lower shoot bolt 330. This then causes the lower shoot bolt to move back up in the lock (in the opposite direction to arrow (xiii)), and the rocker member 350 pivots (in the opposite direction to arrow (xiv)) to also drag the upper shoot bolt 310 back down into the lock in the opposite direction to arrow (xv). This is how the shoot bolts can be retracted to retract the remote bolts.

It will be appreciated that rotation of the drive member 281 will cause the pivot member 341 and the hook member 342 to move around as generally indicated by arrow (xvi), even if the shoot bolts have not already been extended. However, this will have no effect on the shoot bolts if the shoot bolts are not extended. Also, it will be appreciated that because the retraction of the shoot bolts requires the handle 112 to be rotated downwards past the horizontal in the direction of arrow (i) (see FIG. 2), this cannot be done when the snib mechanism is engaged, or when the lock is deadlocked, because in both cases the handle is locked against rotation. Hence, the shoot bolts can only be retracted as just described if the lock is in the passage mode such that the handle 112 can be rotated downwards past the horizontal in the direction of arrow (i).

It was explained above that if the lock is in the secure mode but the shoot bolts have not been extended to throw the remote bolts, then it is possible to rotate the handle 112 upwards in the direction of arrow (iii) (see FIG. 3) to extend the shoot bolts and throw the remote bolts. After this, the handle 112 can return to the horizontal position and the shoot bolts (and remote bolts) remain extended. However, when the lock is in the secure mode, the mechanism prevents the handles from being rotated downwards past the horizontal in the direction of arrow (i). Therefore, it is not possible to use the handle 112 to withdraw the shoot bolts and retract the remote bolts while the lock remains in the secure mode. In addition to this, if the shoot bolts are extended while the lock is in the secure mode, the shoot bolts become locked against retraction so that any external attempt to forcibly push the shoot bolts back into the lock (to try and retract the remote bolts) is resisted. This is achieved through the mechanism shown in FIGS. 24-26.

Figure 24:
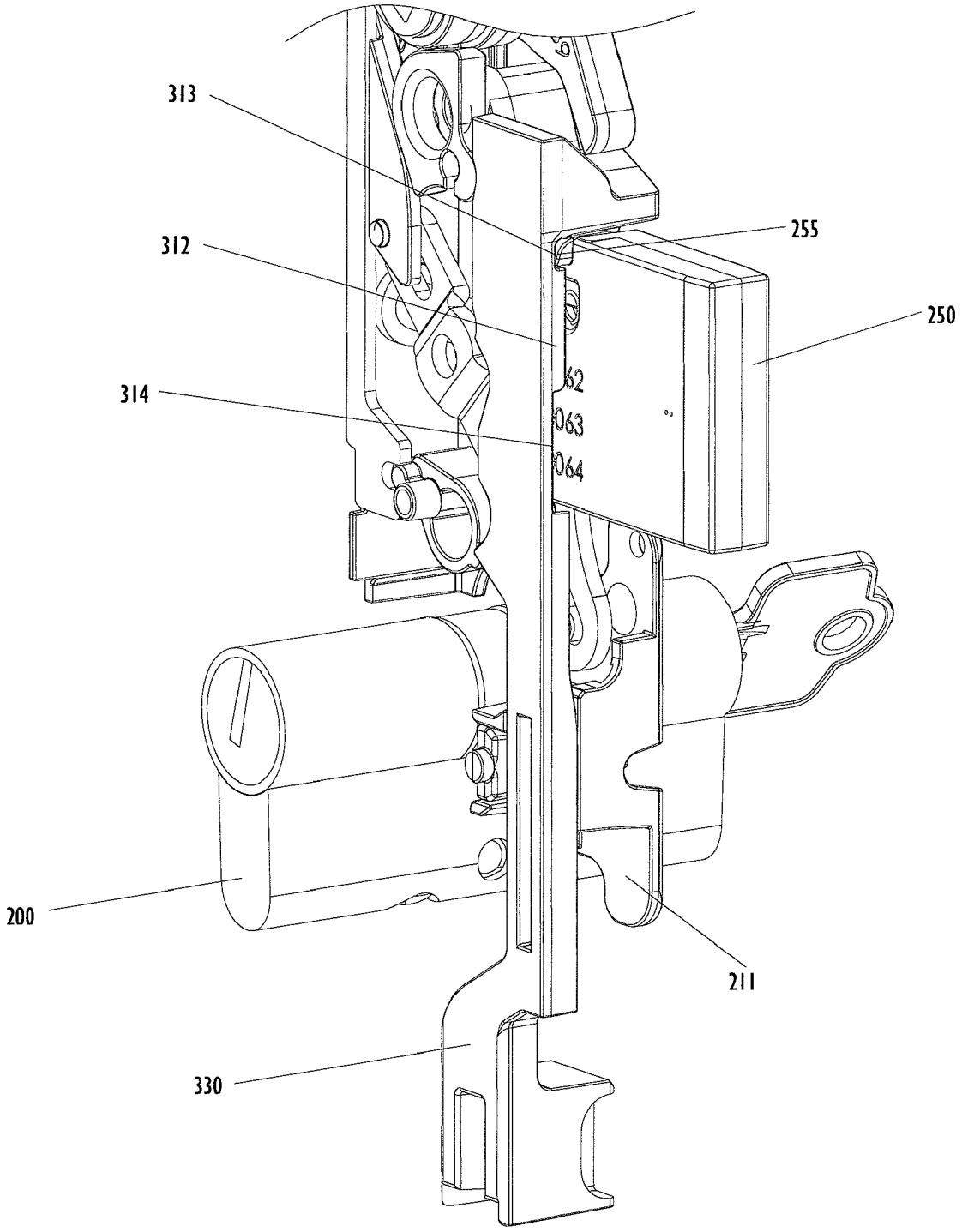
FIG. 24 is a partial perspective view of the internal workings of the lock showing, in particular, the way the deadbolt engages with the lower shoot bolt to prevent the shoot bolts from being retracted while the deadbolt is extended.

FIGS. 25 and 26 show that there is a spring-loaded auxiliary tongue 255 mounted in the upper part of the deadbolt 250 towards the rear of the deadbolt. The auxiliary tongue 255 projects out to one side of the deadbolt 250 under the bias of the spring. Referring next to FIG. 1, it can be seen that the lower shoot bolt 330 has a raised portion 312 and a locking recess 313 near its upper end. If the lock is in the secure mode such that deadbolt 250 is thrown, but the shoot bolts have not been extended, then the extension of the deadbolt 250 forwardly in the lock will cause the auxiliary tongue 255 to become positioned beneath the raised portion 312. In fact, the auxiliary tongue 255 will project into the space marked 314 in FIG. 1, below the raised portion 312. If the handle 112 is then rotated upwards to extend the shoot bolts while lock is deadlocked, the lower shoot bolt 330 will move downwards and this causes the raised portion 312 the come into contact with the auxiliary tongue 255. When this happens, the raised portion 312 will push against the tapered surface of the auxiliary tongue 255 pushing the auxiliary tongue 255 back into the deadbolt 250 against the bias of its spring. The lower shoot bolt 330 will then continue to move down until the locking recess 313 in the shoot bolt 330 becomes aligned with the auxiliary tongue 255. At this point, the auxiliary tongue 255 will project back out into the locking recess 313. This is shown in FIG. 24. Thereafter, any attempt to force the lower shoot bolt back up into the lock (or alternatively any attempt to force the upper shoot bolt 310 downwards into the lock) will be prevented because the raised portion 312 will collide with the extended auxiliary tongue 255. Hence, the only way to retract the shoot bolts from this point is to first use the key to retract the deadbolt 250 (i.e. un-deadlocked the lock) which causes the auxiliary tongue 255 to move backwards in the lock completely out of engagement with the lower shoot bolt 330.

Something else that is worth noting about the function of the lock is that it is possible to rotate the snib lever 113 in the direction of arrow (ii) (see FIG. 3) to "snib" the lock while the door is open, and then close the door, and the lock will remain in the "snibbed" condition (i.e. the secure mode) after the door is closed. Hence, the way the latch tongue 260 is pushed back into the lock when it comes into contact with the door jam or strike, and then extends back out when the door is fully closed, does not interfere with the "snibbed" condition of the lock. This is because the configuration of the hub assembly 280 permits a degree of free motion between the drive member 281 and the hubs 282, 283. More specifically, when the latch tongue 260 comes into contact with, and is forced back by, the door jam or strike as the door closes, this also causes the drive member 281 to pivot. However, the hubs 282 and 283 do not rotate with the drive member 281 and the detent 424 of the snib assembly can remain in engagement with the first hub 282 (preventing rotation of the hubs in the direction of arrow (ix)—see FIG. 8) irrespective of the retraction of the latch bolt 260. In other words, when the lock is in the configuration shown in FIG. 5, the latch bolt 260 can be depressed into the lock (which also causes the drive member 281 to pivot), but the hubs 282 and 283 and snib bar 421 remain in the position shown so that the lock remains snibbed.

Yet another aspect of the lock's function that should be noted is that the action of using the key to "deadlock" the lock necessarily also has the effect of "un-snibbing" the lock. In other words, using the key to throw the deadbolt 250 causes the snib mechanism to move from the "snibbed" configuration shown in FIGS. 5 and 6 into the "un-snibbed" configuration shown in FIGS. 7 and 8. This is because the cylinder cam 201 pushes the snib bar 421 back up into the un-snibbing position as it passes from the position shown in FIG. 5 into engagement with the Talon assembly (as described above). The fact that using the key to throw the deadbolt 250 causes the snib mechanism to move from the "snibbed" configuration into the "un-snibbed" configuration is important because if it were not possible to un-snib the lock with the key, it would not be possible for a user to get in from the outside if the lock was snibbed.

The lock shown in FIGS. 1-33 also has a lock status indicator assembly 380. The lock status indicator assembly 380 is shown in exploded views in FIGS. 1 and 27, and its assembled configuration can be seen from FIGS. 28-31 and 33. The assembly 380 comprises three components. The first is a passage/safety mode indicating component 381. This component is made from green plastic and will therefore be referred to as the "green" component 381. The second component is a secure mode indicating component 382. The secure mode indicating component is made from red plastic and will be referred to as the red component 382. The third component is the indicator arm 383.

Figure 33:
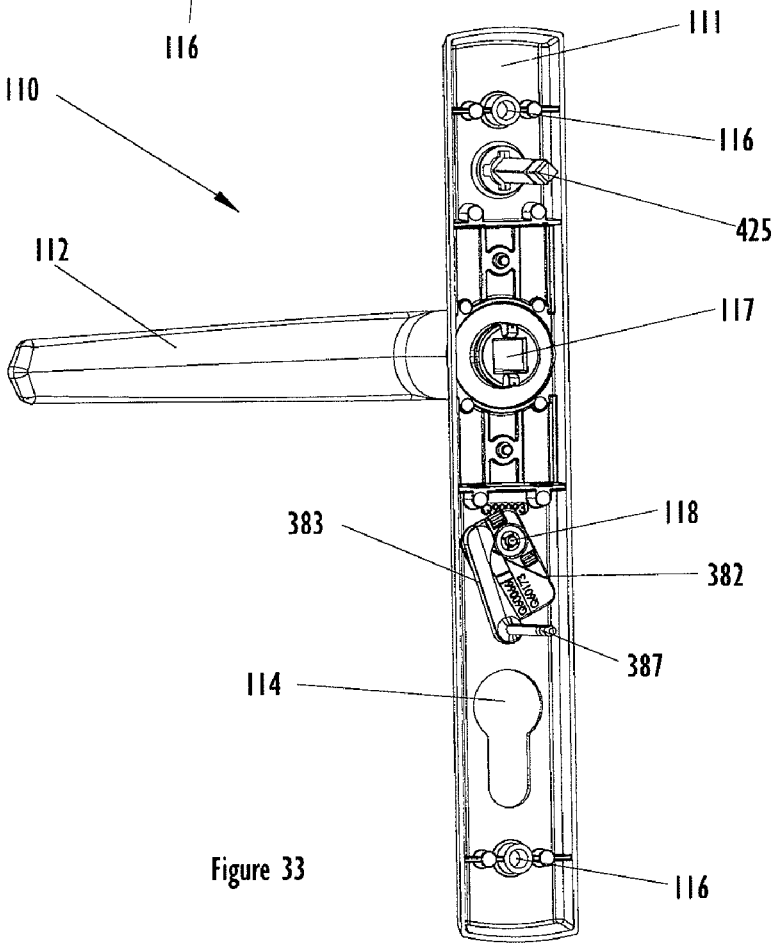
FIG. 33 shows the backside of the escutcheon and the way the lock status indicator assembly is mounted thereon for engagement and operation with the internal workings of the lock.
Figure 34:
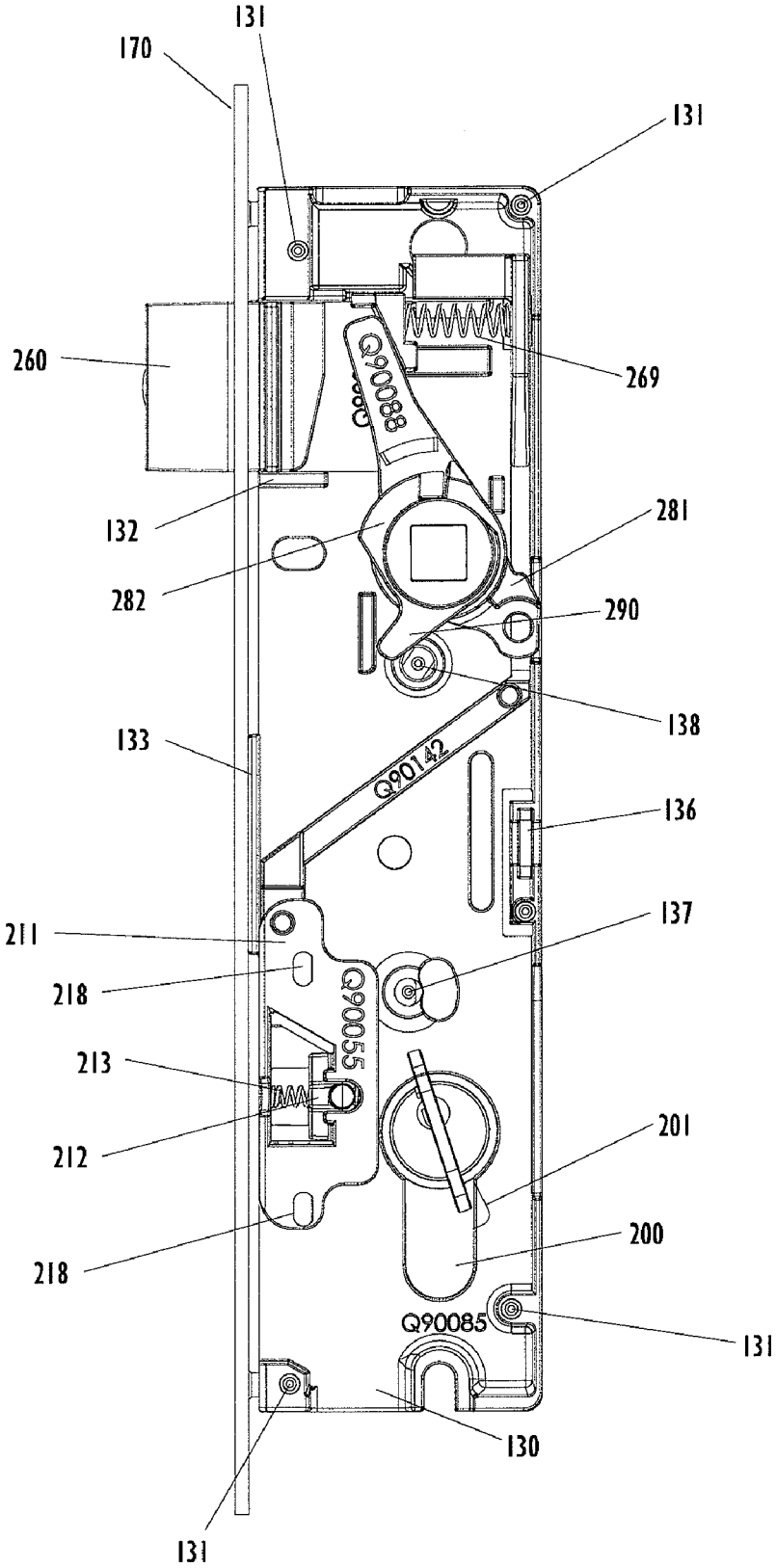
FIG. 34 is a side on view of a lock in accordance with an alternative simpler embodiment of the invention with the cover plate removed to show the lock's internal workings.

As can be seen from FIG. 33, when the indicator assembly 380 is assembled, the red component 382 overlaps with green component 381 such that the holes 384 in the respective components (see FIG. 27) come into register. In other words, the holes 384 become axially aligned with each other when the green component 381 is assembled to the red component 382. When the red and green components are assembled together in this way, they can both be attached to a mounting post 118 on the inside of the escutcheon 111. The mounting post inserts through the axially aligned holes 384. The mounting post 118 is visible in FIG. 33, and it can also be seen that a circular retaining clip is used to secure the components on the post 118.

The indicator arm 383 has a short circular lug 385 projecting from one end, and a long pin 387 projecting from the other end in the opposite direction to lug 385. When the indicator assembly is installed on the inside of the escutcheon 111, the lug 385 inserts into a hole 386 in the green component 381 (see FIG. 27). Consequently, the pin 387 points towards the inside of the lock as shown in FIG. 33.

Figure 28:
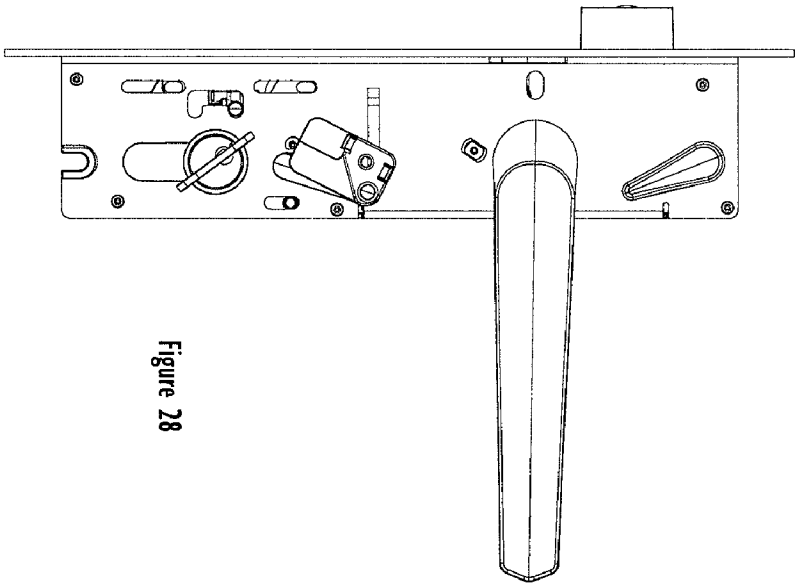
FIGS. 28 and 29 are both similar and show the position of the lock status indicator when the lock is in the passage mode.
Figure 29:
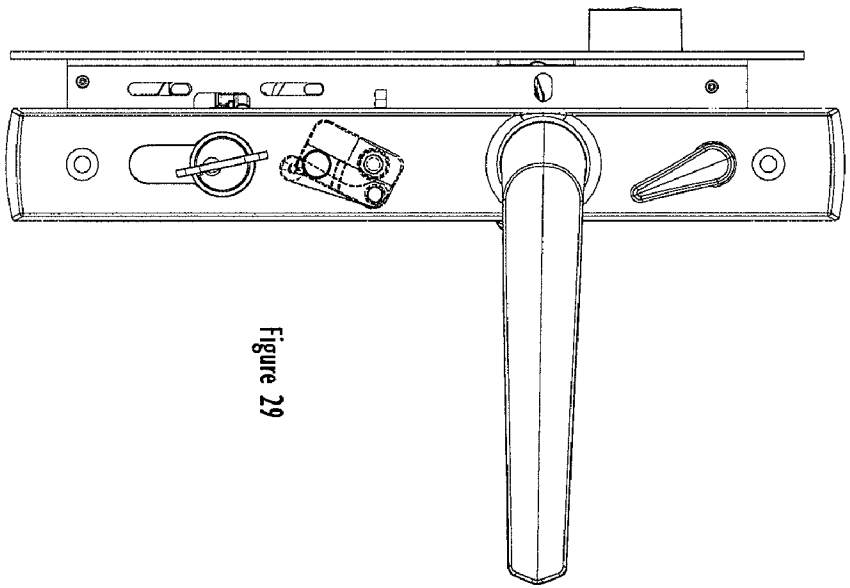
Figure 30:
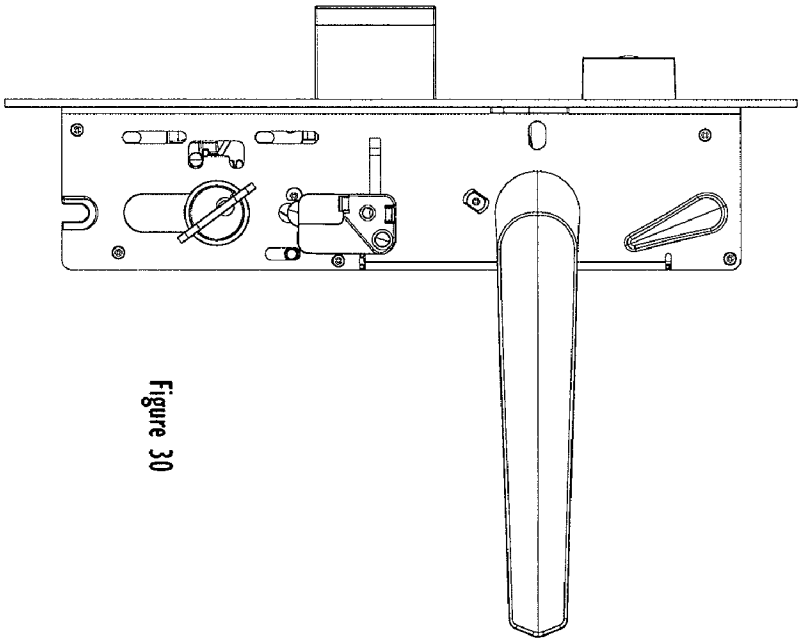
FIGS. 30 and 31 are also both similar and show the position of the lock status indicator when the lock is in the secure mode.
Figure 31:
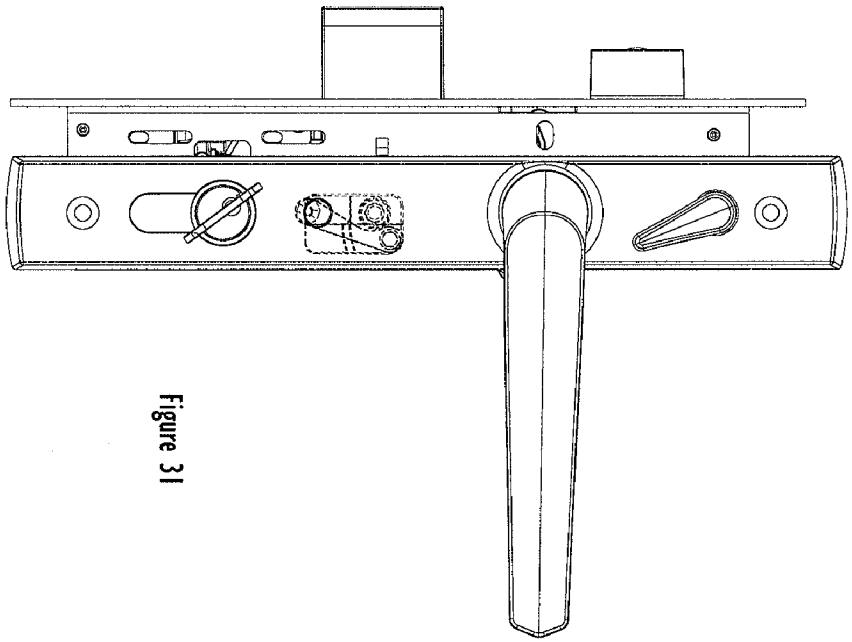
Figure 32:
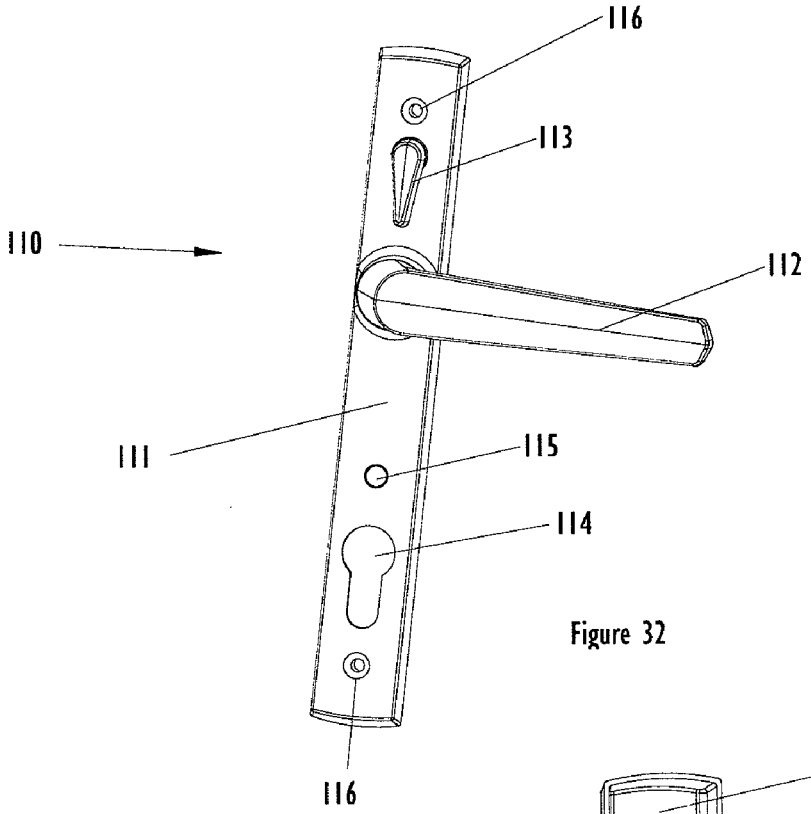
FIG. 32 is a perspective view of the exterior furniture of the lock (i.e. the escutcheon, lever handle and snib lever). The furniture is "exterior" in the sense that it is on the outside of the lock when assembled, but the furniture shown in FIG. 32 is mounted on the inside of the door.

The pin 387 actually extends through the aperture 157 in the cover plate 150 (see FIG. 1) and inserts into a hole in the lock status indicator takeoff component 235. The lock status indicator takeoff component 235 is shown in FIGS. 1, 17-19. Consequently, when the key is turned in the key barrel to thereby move the Talon assembly 210 to deadlock or un-deadlock the lock, this in turn causes the locking link 230 to pivot in one direction or the other. This pivotal movement causes of takeoff component 235 to pivot accordingly, thereby imparting pivotal motion into the green component 381 and red component 382 which are mutually connected together and move as one. More specifically, when the key is turned to deadlock the lock, the mutually connected red and green components pivot so that the red component 382 becomes visible through the lens 115 in the escutcheon as shown in FIGS. 30-31. Conversely, when the key is turned to un-deadlock the lock, the mutually connected red and green components pivot so that the green component 381 becomes visible through the lens 115, as shown in FIGS. 28-29. Note: the configuration of the indicator assembly show in FIGS. 28-31 is slightly different to that shown in the other Figures, but the overall function is the same.

As stated at the beginning of this section, the present invention can be embodied in locks which are simpler (i.e. locks with less sophisticated mechanisms and functionality) than the premium lock described above with reference to FIGS. 1-33.

One slightly simpler variation would be a "two-point" lock (as distinct from the four point lock assembly described above). In a "two-point" lock, there would be no remote bolts and therefore no need for connecting rods to attach the remote bolts to the shoot bolts. In other words, the central lock would constitute the entire two-point lock assembly. A lock of this two-point type could be made by altering the embodiment described in FIGS. 1-33 by removing at least the top portion of the upper shoot bulk 310 and the bottom portion of the lower shoot bulk 330 (i.e. by removing the boxlike portions of the shoot bolts which attach to the connecting rods).

Furthermore, because such a two-point lock would have no need to extend the shoot bolts to operate the remote bolts, an additional component may be provided in the lock to prevent the handle 112 from pivoting upwards past the horizontal position. Such a component could be provided in the lock mechanism itself, or alternatively on the inside of the escutcheon 111.

An even simpler variation would be a "one-point" lock, and one possible embodiment of such a lock is shown in FIG. 34. In FIG. 34, where the particular components are the same as those described above with reference to FIGS. 1-33, the same reference numerals will be used. Where the components are mostly the same but with slight differences, a prime notation (e.g. first hub 282') will be used to indicate that the component in FIG. 34 differs slightly from the equivalent component in FIGS. 1-33. Finally, for components in FIG. 34 which have no equivalent in the earlier Figures, new reference numerals will be used.

The lock shown in FIG. 34 is a "one-point" lock because it only has a latch tongue (there are no remote bolts and no deadbolt). In other words, there is only a single "point" of engagement between the lock and the doorframe or strike, namely the latch tongue 260. The latch tongue 260 in FIG. 34 is the same as that shown in the previous Figures.

The hub assembly 280' is mostly the same as that described above. However, the wing 290' on the first hub 282' is slightly different. The wing 290' engages with the upstanding post 138. This prevents the hub (and hence the handles) from rotating upwardly past the horizontal (anti-clockwise in FIG. 34). There is no need for the handle to rotate in this direction in this embodiment because there are no shoot bolts to extend etc. It should be noted that the first hub 282 used in the premium lock above could also be used in this single point embodiment, and a small additional component could be attached to the wing 290 (or alternatively to the post 138) to similarly restrict upwards movement of the handles. Alternatively, the first hub 282 from the premium lock could be used without any modifications in the single point embodiment, and the lock furniture could be provided with a mechanism for preventing upward movement of the handles. Some "one point" embodiments may utilise rose furniture which means that use of the first hub 282 is prevented.

The key cylinder 200 and Talon assembly 210 shown in FIG. 34 are substantially the same as those described above with reference to FIGS. 1-33. They also interact with "[]"-shaped cut-outs in the body and cover plate in the same way (the "[]"-shaped cutouts are not visible in FIG. 34). However, unlike the more sophisticated lock described above, the lock in FIG. 34 does not have a lock link attached to the Talon mechanism. Instead, the lock has a simple locking member 503. A lug on the bottom of the locking member 503 inserts into a hole 502 in the top of the Talon chassis 211. The hole 502 cam be seen in FIGS. 11-12 as well.

FIG. 34 shows that the locking member 503 has a diagonal portion which extends from just above the Talon chassis 211 diagonally up towards the back wall of the body 130. The locking member 503 then extends up the back wall of the body 130, and it has a projecting rectangular portion on top (the rectangular portion is substantially identical to the rectangular portion 242 described above). Hence, when a key is turned in the key cylinder 200 to drive the Talon assembly 210 downwardly in the lock (this works in exactly the same way as described above), this moves the locking member 503 downwardly in the lock so that the rectangular portion of the locking member becomes positioned behind the back of the latch bolt 260'. After this, any attempt to retract the latch bolt (whether using the handle or in an unauthorised manner using a jemmy etc) will cause the rear of the latch bolt 260 to collide with the rectangular portion. This is how the handle is prevented from being used to retract the latch tongue when this simple one point embodiment is "locked". If the user attempts to rotate the handle to try and retract the latch bolt 260 while the lock is in this configuration, the rear of the latch tongue will immediately collide with the rectangular portion of the locking member.

It will be clearly appreciated that modifications and alterations could be made to the various embodiments just described without departing from the spirit and scope of the invention.

Finally, it should be noted that this specification has been prepared using voice recognition software and may therefore contain occasional "sounds like" errors where the software has misrecognized a spoken word. An example of such an error might be if the text were to contain a reference to "arm-locking" instead of the correct word "unlocking", or if the text referred to the "rowing" of the deadbolt rather than "throwing" of the deadbolt, or to "attraction" rather than "retraction". "Sounds like" errors such as these will be immediately recognized by those skilled in this field and the intended word will be obvious from the surrounding descriptions and context.

LIST OF PARTS AND FEATURES OF PREMIUM LOCK AS SHOWN IN FIGS. 1-33

Furniture 110
111—escutcheon
112—operating handle
113—snib lever
114—key cylinder aperture
115—status indicator lens
116—screw mounting holes
117—square spindle aperture in handle
118—lock status indicator mounting post
Locking Link 230
231—Pivot hole
232—slot for receiving Talon lug
233—plug for inserting into deadbolt slot
234—connecting hole for locking bar lug

235—lock status indicator takeoff component
Forend Plate 170
Body 130
131—cover plate fixing lugs
132—upstanding latch tongue guide wall
133—upstanding deadbolt guide wall
134—key barrel cut-out
135—"[]"-shaped Talon cut-out
136—deadbolt pin slot
137—lock link mounting post
138—post below the latch bolt
Locking Bar 240
241—central portion
242—upper rectangular portion
243—lower connecting portion
244—connecting lug
Deadbolt Assembly 250
251—deadbolt recess for receiving the plug on the locking link
252—deadbolt pin
253—U-shaped mounting portion on rear of the deadbolt pin
254—the hole in the core of the deadbolt for the pin
255—auxiliary tongue
Cover Plate 150
151—body fixing holes
152—handle spindle hole
153—snib spindle hole
154—key barrel cut-out
155—"[]"-shaped Talon cut-out
156—guide channels
157—lock status indicator pin aperture
Key Cylinder 200
201—cylinder cam
Shoot Bolt Return Assembly 340
341—pivot member
342—hook member
343—small lug which connects pivot member to hub drive member
344—large lug that connects pivot member to hook member
345—recess in hook member that accepts pivot member's large lug
Snib Mechanism 420
421—snib bar
422—snib actuator
423—square aperture in snib actuator
424—detent on snib bar
425—snib spindle
426—rectangular portion on lower end of snib bar
Talon Assembly 210
211—Talon chassis
212—Talon bolt
213—Talon return spring
214—lugs on either side of the Talon bolt
215—spaces through which the Talon bolt lugs extend
216—space where the spring is mounted
217—lug which connects to the locking link
218—guide lugs
219—angled surfaces
220—rounded end of one of the spaces
Hub Assembly 280
281—latch bolt drive member
282—first hub
238—second hub
284—square spindle apertures
285—drive protrusions on the hubs
286—driven protrusions on the drive member
287—drive member's driving arm
288—spring hole
289—snib stop face on first hub
290—wing on the first hub which pushes on the lower shoot bolt
291—tab on drive member
292—hole in tab that connects to pivot member
Shoot Bolts 300
310—upper shoot bolt
311—rocker connecting lug on upper shoot bolt
330—low shoot bolt
331—rocker connecting lug on lower shoot bolt
312—raised portion on lower shoot bolt
313—locking recess on lower shoot bolt
314—space below raised portion on lower shoot bolt
Lock Status Indicator 380
381—green passage/safety mode indicating component
382—red secure mode indicating component
383—indicator arm
384—holes in the respective red and green components
385—short circular lug on one end of indicator arm
386—hole in green component for receiving indicator lug
387—long pin on other end of short circular lug

The invention claimed is:

1. A mortice lock having a lock casing which provides at least one first point of entrapment and at least one second point of entrapment, a latch bolt which can move between a latching position and an un-latching position, a handle for moving the latch bolt between the latching position and the un-latching position a key cylinder, an operating assembly that can move between a first position in which a deflectable portion of the operating assembly engages with the at least one first point of entrapment and a second position in which the deflectable portion engages with the at least one second point of entrapment, wherein only the key cylinder can move the operating assembly between the first position and the second position, and a locking member that can move between a locking position in which a portion of the locking member prevents the latch bolt from moving into the un-latching position, and an unlocking position in which the latch bolt can move into the un-latching position wherein the locking member is operatively associated with the operating assembly such that moving the operating assembly into the first position moves the locking member into the unlocking position and moving the operating assembly into the second position moves the locking member into the locking position.

2. A mortice lock according to claim 1 wherein the lock casing includes a body and a cover plate.

3. A mortice lock according to claim 2 wherein the first and second points of entrapment are formed at a respective position on the lock casing which is selected from any one of the following: on the body, on the cover plate, and on the body and on the cover plate.

4. A mortice lock according to claim 2 wherein the at least one first and second points of entrapment are defined by one or more features, said features being formed from one or a combination of the following: shaped portions, cut-outs, sculptings, and folds.

5. A mortice lock according to claim 4 wherein the at least one first point of entrapment is formed at an upper end of the said one or more features and the at least one second point of entrapment is formed at a lower end of the said one or more features, and wherein the said one or more features include a section which connects the at least one first and second points of entrapment which guides the operating assembly between the at least one first and second points of entrapment.

6. A mortice lock according to claim 1 wherein the latch bolt includes a sound damping component for dampening the noise created by contact between bevelled portion of the latch bolt and a strike or doorframe.

7. A mortice lock according to claim 1 which includes a hub assembly having one or more hub components which are mounted for pivotal movement in the lock casing and by which the latch bolt is moved between the latching and unlatching positions.

8. A mortice lock according to claim 7 which includes a drive member and wherein the hubs are configured so that rotation of the hubs causes rotation of the drive member; and wherein rotation of the hubs in one direction causes the drive member to rotate in the same direction to the same angular extent, but rotation of the hubs in an opposite direction does not cause rotation of the drive member.

9. A mortise lock according to claim 5, wherein each of the said one or more features comprises a "["-shaped cutout in the body and/or the cover plate, wherein an upper horizontal portion of each "["-shaped cutout comprises the at least one first point of entrapment, and a lower horizontal portion of each "["-shaped cutout comprises the at least one second point of entrapment, and the deflectable portion of the operating assembly includes one or more inserts which insert into one or more of the said cutouts.

10. A mortise lock according to claim 1, wherein the locking member is directly connected to a portion of the operating assembly such that moving the operating assembly into the first position directly moves the locking member into the unlocking position and moving the operating assembly into the second position directly moves the locking member into the locking.

11. A mortise lock according to claim 1, wherein the locking member is operatively associated with the operating assembly via a deadlock mechanism, the deadlock mechanism also being operatively associated with a deadbolt such that the deadbolt is moved by the deadlock mechanism between a retracted position in which the deadbolt does not extend out from the lock, and a thrown position in which it extends out from the lock.

12. A mortise lock according to claim 11, wherein the deadlock mechanism includes a linking member, the linking member being a rigid component that attaches to the operating assembly and also to the deadbolt such that moving the operating assembly from the first position to the second position moves the deadbolt from the retracted position to the thrown position.

13. A mortise lock according to claim 1 comprising a handle on both the inside and the outside of the lock and a snib mechanism, wherein when the lock is assembled the snib mechanism is operable to convert the lock between a passage mode in which it is possible to use either handle to retract the latch bolt, and a safety mode in which the lock cannot be operated from the outside unless a key is first inserted from the outside and turned in the key cylinder to disengage the snib mechanism thereby returning the lock to the passage mode.

14. A mortise lock according to claim 13 wherein the inside and outside handle can be rotated in a first direction to retract the latch bolt when the lock is in the passage mode, and the lock further incorporates one or more shoot bolts each of which optionally connects to a remote bolt, each shoot bolt being movable between a retracted position and an extended position whereby the remote bolts, if connected to the shoot bolts, extend when the shoot bolts extend and retract when the shoot bolts retract, wherein the shoot bolts can be moved from the retracted position to the extended position by rotating one of the lock's handles in a second direction.

15. A mortise lock according to claim 14 further comprising a shoot bolt retraction mechanism operable such that, if the shoot bolts are in the extended position, then rotating the handle(s) in the first direction operates the shoot bolt retraction mechanism to move the shoot bolts from the extended position to the retracted position.

* * * * *